US008907272B1

(12) United States Patent
Wouters et al.

(10) Patent No.: US 8,907,272 B1
(45) Date of Patent: Dec. 9, 2014

(54) RADIO FREQUENCY DEVICE TO SEPARATE IONS FROM GAS STREAM AND METHOD THEREOF

(71) Applicant: Thermo Finnigan LLC, San Jose, CA (US)

(72) Inventors: Eloy R. Wouters, San Jose, CA (US); R. Paul Atherton, San Jose, CA (US); Satendra Prasad, San Jose, CA (US); Jean-Jacques Dunyach, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/046,020

(22) Filed: Oct. 4, 2013

(51) Int. Cl.
*H01J 49/26* (2006.01)
*H01J 49/36* (2006.01)
*H01J 49/00* (2006.01)

(52) U.S. Cl.
CPC ..... *H01J 49/36* (2013.01); *H01J 49/0027* (2013.01)
USPC ..... 250/288; 250/281; 250/282

(58) Field of Classification Search
USPC ..... 250/281–283, 286, 288, 289, 290, 396 R
See application file for complete search history.

(56) References Cited

U.S. PATENT DOCUMENTS

| | | | | |
|---|---|---|---|---|
| 5,572,035 | A | 11/1996 | Franzen | |
| 6,107,628 | A | 8/2000 | Smith et al. | |
| 6,583,408 | B2 | 6/2003 | Smith et al. | |
| 7,696,474 | B2 * | 4/2010 | Wu et al. | 250/281 |
| 7,781,728 | B2 * | 8/2010 | Senko et al. | 250/281 |
| 2009/0045062 | A1 * | 2/2009 | Senko et al. | 204/547 |
| 2011/0049357 | A1 | 3/2011 | Giles | |
| 2012/0112059 | A1 * | 5/2012 | Sugiyama et al. | 250/282 |
| 2013/0120894 | A1 | 5/2013 | van Amerom et al. | |
| 2013/0175440 | A1 | 7/2013 | Perelman et al. | |
| 2013/0207000 | A1 * | 8/2013 | Gunther et al. | 250/396 R |

FOREIGN PATENT DOCUMENTS

WO WO 2009/037483 A2 3/2009

OTHER PUBLICATIONS

Takamine et al., "Space-charge effects in the catcher gas cell of a rf ion guide," Rev. Sci. Instrum. 76, 103503 (2005), pp. 1-6.

* cited by examiner

*Primary Examiner* — Bernard E Souw
(74) *Attorney, Agent, or Firm* — Thomas F. Cooney

(57) ABSTRACT

A method for transporting ions within a mass spectrometer comprises: inputting the ions and neutral molecules to a first end of an ion transport apparatus comprising a plurality of non co-planar ring-shaped electrode portions having respective central apertures having centers that lie along a common axis and that define an ion channel, the radii of the central apertures decreasing in a direction from the first end to a second end of the ion transport apparatus; applying a set of Radio Frequency voltages to the plurality of electrode portions such that the ions remain substantially confined to the ion channel while passing from the first to the second end; and exhausting the neutral molecules from the ion transport apparatus though a plurality of channels or apertures other than the apertures that define the ion channel, the exhausting performed in one or more directions that are non-perpendicular to the axis.

26 Claims, 11 Drawing Sheets

RADIO FREQUENCY DEVICE TO SEPARATE IONS FROM GAS STREAM AND METHOD THEREOF

FIELD OF THE INVENTION

The present invention relates generally to ion optics for mass spectrometers, and more particularly to a device for transferring ions from one or more atmospheric-pressure or near-atmospheric-pressure ion source to an evacuated region.

BACKGROUND OF THE INVENTION

Mass spectrometry analysis techniques are generally carried out under conditions of high vacuum. However, various types of ion sources used to generate ions for MS analyses operate at or near atmospheric pressures. Thus, those skilled in the art are continually confronted with challenges associated with transporting ions and other charged particles generated at atmospheric or near atmospheric pressures, and in many cases contained within a large gas flow, into regions maintained under high vacuum.

Various approaches have been proposed in the mass spectrometry art for improving ion transport efficiency into low vacuum regions. For example, FIGS. 1A-1B are two schematic depictions of mass spectrometer systems 1-2 which utilize an ion transport apparatus to so as to deliver ions generated at near atmospheric pressure to a mass analyzer operating under high vacuum conditions. As one example, analyte ions may be formed by the electrospray technique by introducing a sample comprising a plume 9 charged ions and droplets into an ionization chamber 7 via an electrospray probe 10. For an ion source that utilizes the electrospray technique, ionization chamber 7 will generally be maintained at or near atmospheric pressure. Although an electrospray ion source is illustrated, the ion source may comprise any other conventional continuous or pulsed atmospheric pressure ion source, such as a thermal spray source, an APCI source or a MALDI source.

In the systems 1-2 illustrated in FIGS. 1A-1B, the analyte ions, together with background gas and partially desolvated droplets, flow into the inlet end of a conventional ion transfer tube 15 (e.g., a narrow-bore capillary tube) and traverse the length of the tube under the influence of a pressure gradient. Analyte ion transfer tube 15 is preferably held in good thermal contact with a heating block 12. The analyte ions emerge from the outlet end of ion transfer tube 15, which opens to an entrance 27 of an ion transport device 5 located within a first low vacuum chamber 13. As indicated by the arrow, chamber 13 is evacuated to a low vacuum pressure by, for example, a mechanical pump or equivalent through vacuum port 31. Under typical operating conditions, the pressure within the low vacuum chamber 13 will be in the range of 1-10 Torr (approximately 1-10 millibar), but it is believed that the ion transport device 5 may be successfully operated over a broad range of low vacuum and near-atmospheric pressures, e.g., between 0.1 millibar and 1 bar.

After being constricted into a narrow beam by the ion transport device 5, the ions are directed through aperture 22 of extraction lens 14 so as to exit the first low pressure chamber 13 and enter into an ion accumulator 36, which is likewise evacuated, but to a lower pressure than the pressure in the first low pressure chamber 13, also by a second vacuum port 35. The ion accumulator 36 functions to accumulate ions derived from the ions generated by ion source 10. The ion accumulator 36 can be, for example, in the form of a multipole ion guide, such as an RF quadrupole ion trap or a RF linear multipole ion trap. Where ion accumulator 36 is an RF quadrupole ion trap, the range and efficiency of the ion mass-to-charge ratios captured in the RF quadrupole ion trap may be controlled by, for example, selecting the RF and DC voltages used to generate the quadrupole field, or applying supplementary fields, e.g. broadband waveforms. A collision or damping gas such as helium, nitrogen, or argon, for example, can be introduced via inlet 23 into the ion accumulator 36. The neutral gas provides for stabilization of the ions accumulated in the ion accumulator and can provide target molecules for collisions with ions so as to cause collision-induced fragmentation of the ions, when desired.

The ion accumulator 36 may be configured to radially eject the accumulated ions towards an ion detector 37, which is electronically coupled to an associated electronics/processing unit 24. The ion accumulator 36 may alternatively be configured to eject ions axially so as to be detected by ion detector 34. The detector 37 (or detector 34) detects the ejected ions. Sample detector 37 (or detector 34) can be any conventional detector that can be used to detect ions ejected from ion accumulator 36.

Ion accumulator 36 may also be configured, as shown in FIG. 1B, to eject ions axially towards a subsequent mass analyzer 45 through aperture 28 (optionally passing through ion transfer optics which are not shown) where the ions can be analyzed. The ions are detected by the ion detector 47 and its associated electronics/processing unit 44. The mass analyzer 45 may comprise an RF quadrupole ion trap mass analyzer, a Fourier-transform ion cyclotron resonance (FT-ICR) mass analyzer, an Orbitrap™ electrostatic-trap type mass analyzer or other type of electrostatic trap mass analyzer or a time-of-flight (TOF) mass analyzer. The analyzer is housed within a high vacuum chamber 46 that is evacuated by vacuum port 43. In alternative configurations, ions that are ejected axially from the ion accumulator 36 may be detected directly by an ion detector (47) within the high vacuum chamber 46. As one non-limiting example, the mass analyzer 45 may comprise a quadrupole mass filter which is operated so as to transmit ions that are axially ejected from the ion accumulator 36 through to the detector 47.

FIGS. 1A-1B illustrate two particular examples of mass spectrometer systems in which ion transport devices may be used to deliver ions from an atmospheric or near-atmospheric ion source into a vacuum chamber. Such ion transport devices may be of various types including, for example, the ion transport device illustrated in FIG. 2A, well-known ion funnel devices, the improved ion transport apparatus disclosed herein (discussed below), as well as other types. All these ion transport devices may be generally employed in other types of mass spectrometer systems in addition to the systems shown in FIGS. 1A-1B. For example, whereas the systems of FIGS. 1A-1B include an ion accumulator or ion trap (36), other mass spectrometer systems, such as triple-quadrupole mass spectrometer systems, may similarly advantageously employ such ion transport devices (as are known in the art or as described in the present teachings). Instead of employing an ion accumulator or ion trap mass analyzer, triple quadrupole systems (not specifically illustrated in the drawings) instead generally employ a sequence of quadrupole apparatuses comprising: a quadrupole mass filter (Q1), an RF-only quadrupole collision cell (Q2) and a second quadrupole mass filter (Q3). As with the systems illustrated in FIGS. 1A-1B, these mass analyzer components reside in one or more evacuated chambers and, thus, an ion transport apparatus as disclosed herein may be advantageously employed if ions are generated in an atmospheric or near-atmospheric ion source.

FIG. 2A depicts (in rough cross-sectional view) details of an example of an ion transport device 5 as taught in U.S. Pat. No. 7,781,728, which is assigned to the assignee of the instant invention and is hereby incorporated by reference herein in its entirety. Ion transport device 5 is formed from a plurality of generally planar electrodes 38, comprising a set of first electrodes 16 and a set of second electrodes 20, arranged in longitudinally spaced-apart relation (as used herein, the term "longitudinally" denotes the axis defined by the overall movement of ions along ion channel 32). Devices of this general construction are sometimes referred to in the mass spectrometry art as "stacked-ring" ion guides. An individual electrode 38 is illustrated in FIG. 2B. FIG. 2B illustrates that each electrode 38 is adapted with an aperture 33 through which ions may pass. The apertures collectively define an ion channel 32 (see FIG. 2A), which may be straight or curved, depending on the lateral alignment of the apertures. To improve manufacturability and reduce cost, all of the electrodes 38 may have identically sized apertures 33. An oscillatory (e.g., radio-frequency) voltage source 42 applies oscillatory voltages to electrodes 38 to thereby generate a field that radially confines ions within the ion channel 32. According to a preferred embodiment, each electrode 38 receives an oscillatory voltage that is equal in amplitude and frequency but opposite in phase to the oscillatory voltage applied to the adjacent electrodes. As depicted, electrodes 38 may be divided into a plurality of first electrodes 16 interleaved with a plurality of second electrodes 20, with the first electrodes 16 receiving an oscillatory voltage that is opposite in phase with respect to the oscillatory voltage applied to the second electrodes 20. In this regard, note that the first electrodes 16 and the second electrodes 20 are respectively electrically connected to opposite terminals of the oscillatory voltage source 42. In a typical implementation, the frequency and amplitude of the applied oscillatory voltages are 0.5-3 MHz and 50-400 $V_{p\text{-}p}$ (peak-to-peak), the required amplitude being strongly dependent on frequency.

To create a tapered electric field that focuses the ions to a narrow beam proximate the exit 39 of the ion transport device 5, the longitudinal spacing of electrodes 38 may increase in the direction of ion travel. It is known in the art (see, e.g., U.S. Pat. No. 5,572,035 to Franzen) that the radial penetration of an oscillatory field in a stacked ring ion guide is proportional to the inter-electrode spacing. Near entrance 27, electrodes 38 are relatively closely spaced, which provides limited radial field penetration, thereby producing a wide field-free region around the longitudinal axis. This condition promotes high efficiency of acceptance of ions flowing from the ion transfer tube 15 into the ion channel 32. Furthermore, the close spacing of electrodes near entrance 27 produces a strongly reflective surface and shallow pseudo-potential wells that do not trap ions of a diffuse ion cloud. In contrast, electrodes 38 positioned near exit 39 are relatively widely spaced, which provides effective focusing of ions (due to the greater radial oscillatory field penetration and narrowing of the field-free region) to the central longitudinal axis. A longitudinal DC field may be created within the ion channel 32 by providing a DC voltage source 41 that applies a set of DC voltages to electrodes 38.

In an alternative embodiment of an ion transport device, the electrodes may be regularly spaced along the longitudinal axis. To generate the tapered radial field, in such an alternative embodiment, that promotes high ion acceptance efficiency at the entrance of the ion transport device as well as tight focusing of the ion beam at the device exit, the amplitude of oscillatory voltages applied to electrodes increases in the direction of ion travel.

A second known ion transport apparatus is described in U.S. Pat. No. 6,107,628 to Smith et al. and is conventionally known as an "ion funnel". FIG. 3 provides a schematic depiction of such an ion funnel apparatus 50 in both a longitudinal cross-sectional view and end-on view as viewed along the axis 51. Roughly described, the ion funnel device consists of a multitude of closely longitudinally spaced ring electrodes, such as the four illustrated ring electrodes 52*a*-52*d*, that have apertures that decrease in size from the entrance of the device to its exit. In FIG. 3 as well as in subsequent drawings, different patterns on the representations of the various different electrodes are provided only to aid in visual distinguishing between the various electrode representations and are not intended to imply that the electrodes are necessarily formed of differing materials. The apertures are defined by the ring inner surfaces 53 and the ion entrance corresponds with the largest aperture 54, and the ion exit corresponds with the smallest aperture 55. The electrodes are electrically isolated from each other, and radio-frequency (RF) voltages are applied to the electrodes in a prescribed phase relationship to radially confine the ions to the interior of the device.

The relatively large aperture size at the entrance of the ion funnel apparatus (FIG. 3) provides for a large ion acceptance area, and the progressively reduced aperture size creates a "tapered" RF field having a field free zone that decreases in diameter along the direction of ion travel, thereby focusing ions to a narrow beam which may then be passed through the aperture of a skimmer or other electrostatic lens without incurring a large degree of ion losses. Generally, an RF voltage is applied to each of the successive ring elements so that the RF voltages of each successive element are 180 degrees out of phase with the adjacent element(s). A DC electrical field may be created using a power supply and a resistor chain (not illustrated) to supply the desired and sufficient voltage to each element to create the desired net motion of ions down the funnel. The depiction in FIG. 3 of the ion funnel known in the art is very schematic. Practical implementations of this device often include a first portion of the device that has a plurality of spaced-apart ring electrodes 52*a* all having the same large inner diameter and a second portion of the device having the ring electrodes 52*a*-52*d*, etc. whose inner diameters taper down gradually so as to focus the ions towards the central axis and the smallest orifice at the exit end 55. The first portion is located on the side where the ions enter the device. In operation, the ion-laden gas emerging from the atmospheric pressure enters, by means of one or more ion transfer tubes or orifices, into the first portion of the device where it emerges at high velocity and undergoes rapid gas expansion. The length of the first portion of the device provides a minimum lateral distance between the ion transfer tubes (or other entrance orifice or orifices) and the tapering-diameter second portion within which the forward velocity of the ion laden gas is lowered by collisions with background gas. When the forward velocity of the ion laden gas has sufficiently been lowered, it becomes possible to manipulate the ions with radio frequency electric fields with low enough amplitudes to be below the Paschen breakdown limit, and preferentially guide the ions towards the exit end 55. Refinements to and variations on the ion funnel device are described in (for example) U.S. Pat. No. 6,583,408 to Smith et al., U.S. Pat. No. 7,064,321 to Franzen, EP App. No. 1,465,234 to Bruker Daltonics, and Julian et al., "Ion Funnels for the Masses: Experiments and Simulations with a Simplified Ion Funnel", J. Amer. Soc. Mass Spec., vol. 16, pp. 1708-1712 (2005).

As noted in the foregoing discussion, various conventional mass spectrometer system designs use an ion transfer tube to transport solvent laden cluster ions and gas into a first vacuum chamber of a mass spectrometer where either an ion funnel or an alternative type of stacked ring ion guide is used to capture the ion cloud from the free jet expansion. As the high velocity gas enters the ion funnel or stacked ring ion guide, ions are propelled by the co-expanding gas predominantly in the forward direction and are controlled and guided by the RF field towards a central orifice at the exit end of the ion funnel or stacked ring ion guide. The inventors have observed that, as the high velocity gas impacts solid components of such ion transport apparatuses, it leaves a distinctive mark comprising a residue of contaminants that build up on certain portions of the electrodes. Over time, the continued build up of these deposited contaminants can cause electrical arcing across the closely spaced electrodes. As a result, mass spectrometers that employ such ion transport devices require occasional time-consuming disassembly and cleaning of these devices.

Traditionally ion funnels or stacked ring ion guides are constructed from a stack of parallel plates (metal or metalized around the orifice of an FR-4 printed circuit board), each plate having an orifice. In the case of ion funnels, the orifices are of decreasing diameter in the direction from the apparatus entrance to the apparatus exit. The outside edges of the plates are generally of quasi constant dimensions, shaped, for example, circularly, square, or some combination thereof. In some designs, also solid spacers are inserted between the plates to keep them apart.

As a result of this multiple parallel plate construction, high velocity gas from the expansion out of the ion transfer tube cannot easily escape the ion transport apparatus so that it can be pumped away. Consequently, gas pressure may increase to an undesirable level in the chamber containing the ion transport device. This problem may be especially serious in the case of ion-funnel-type ion transport apparatuses, since the projection of the funnel along its symmetry axis shows or presents only the orifice at the end as an opening for escaping gas. The conductance between successive funnel electrodes is oriented close to perpendicular to the direction of the expansion, which creates a relatively high pressure area in the funnel. This problem has been exacerbated in recent years as the throughput of transfer tubes has been gradually increased via the use of "multi bore capillaries", larger diameter bore, or "letter box" type transfer tubes. This has negatively impacted the ion transmission efficiency of the ion funnel or stacked ring ion guide and, although operation at higher RF frequencies can help to alleviate this problem, reducing the pressure within the device itself is a better solution if one wants to keep increasing the throughput from the atmospheric pressure ionization source. In addition, the robustness of the device (as defined in the number of plasma shots needed before cleaning) is limited by the beam impacting on the electrodes opposite the transfer tube.

SUMMARY OF THE INVENTION

The proposed device consists of an open geometry funnel which will allow separation of ions that are retained by the RF field from the gas stream that will flow through the stacked rings and be pumped away, by the vacuum pump connected to the vacuum chamber that houses the device. This will allow for a better control of the pressure within the device and improve overall ions transmission efficiency while limiting pumping requirements.

In accordance with a first aspect of the present teachings, an apparatus for transporting ions within a mass spectrometer is disclosed, the apparatus comprising: a plurality of electrodes, a plurality of surfaces of which comprise a plurality of non co-planar rings defining a set of respective ion apertures whose diameters decrease from a first end to a second end along a first direction parallel to an axis of the apparatus, the set of ion apertures defining an ion channel through which the ions are transported; and a Radio Frequency (RF) power supply for providing RF voltages to the plurality of electrodes such that the RF phase applied to each electrode is different from the RF phase applied to any immediately adjacent electrodes, wherein the electrodes are disposed such that gaps are defined between each pair of successive electrodes, the gaps being oriented such that a gas flow input into the first end of the apparatus is exhausted through the gaps in one or more directions that are non-perpendicular to the axis.

In various embodiments, the plurality of electrodes may comprise a first set of electrodes and a second set of electrodes interleaved with the first set of electrodes, the electrodes of each set being electrically interconnected, wherein, in operation, the RF power supply supplies a first RF phase to the first set of electrodes and a second RF phase to the second set of electrodes. In various embodiments, the plurality of surfaces may comprise a plurality of end surfaces of a plurality co-axial hollow tubes comprising a plurality of respective tube lengths, the tube lengths of the tubes decreasing in sequence from an outermost one of the tubes to an innermost one of the tubes. In some embodiments, each of the plurality of electrodes is a ring electrode. Each of the plurality of ring electrodes may be supported on a respective one of a plurality of co-axial hollow tubes, each tube being formed of a non-electrically conducting material. The plurality of hollow tubes may comprise a plurality of respective tube lengths, the tube lengths of the tubes decreasing in sequence from an outermost one of the tubes to an innermost one of the tubes. Alternatively, each of the plurality of ring electrodes may be supported on a respective one of a plurality of supporting structures having frustoconical inner and outer surfaces, wherein each supporting structure comprises a respective axis of rotational symmetry that is coincident with the apparatus axis. In some embodiments, each of the plurality of ring electrodes may be supported by one or more spokes disposed non-parallel to the apparatus axis, each of the spokes having an end that is physically coupled to an external housing or supporting device.

In accordance with a second aspect of the present teachings, there is disclosed an apparatus for transporting ions within a mass spectrometer, the apparatus comprising: a plurality of parallel spaced-apart plates, each of the plurality of plates having a central aperture and a plurality of other apertures, a portion of each plate between the central aperture and the other apertures comprising an electrode in the form of a ring about the respective central aperture, the set of central apertures having diameters that decrease from a first end to a second end along a first direction parallel to an axis of the apparatus, the set of central apertures defining an ion channel through which the ions are transported; and a Radio Frequency (RF) power supply for providing RF voltages to the plurality of electrodes such that the RF phase applied to each electrode is different from the RF phase applied to any immediately adjacent electrodes, wherein the other apertures are disposed such that a gas flow input into the first end of the apparatus is exhausted through the other apertures in one or more directions that are non-perpendicular to the axis.

In various embodiments, the parallel plates may be disposed substantially perpendicular to the apparatus axis. In various embodiments, the area of the electrode that is in the form of a ring may increase between two or more successive parallel plates along the first direction. In various embodiments, the other apertures of two or more successive plates may increase in size along the first direction. In various embodiments, the other apertures of at least one plate are asymmetrically disposed about the central aperture. In various embodiments, each plate is formed of a single integral piece comprising an electrically conductive material. In various other embodiments, a portion of each plate other than between the central aperture and the other apertures is formed an electrically non-conductive material.

In accordance with another aspect of the present teachings, there is disclosed a method for transporting ions within a mass spectrometer from an emitter that emits the ions and neutral gas molecules to an entrance aperture of a vacuum chamber comprising: inputting the ions and neutral gas molecules to a first end of an ion transport apparatus comprising a plurality of non co-planar ring-shaped electrode portions having respective central apertures having central aperture centers that all lie along a common axis and that define an ion channel, wherein the radii of the central apertures decrease in a direction from the first end to a second end of the ion transport apparatus; applying a set of Radio Frequency (RF) voltages to the plurality of ring-shaped electrode portions such that the ions remain substantially confined to the ion channel while passing from the first end to an ion outlet at the second of the ion transport apparatus; and exhausting the neutral gas molecules from the ion transport apparatus though a plurality of gas channels or apertures other than the apertures that define the ion channel, the exhausting performed in one or more directions that are non-perpendicular to the axis.

The step of exhausting the neutral gas molecules from the ion transport apparatus though a plurality of gas channels or apertures that surround the ion channel may comprise exhausting the neutral gas molecules from the ion transport apparatus though a plurality of gas channels comprising gaps between a plurality a plurality of nested co-axial hollow tubes. Alternatively, this step may comprise exhausting the neutral gas molecules from the ion transport apparatus though a plurality of apertures in a plurality of electrode plates having the plurality of ring-shaped electrode portions. Alternatively, this step may comprise exhausting the neutral gas molecules from the ion transport apparatus though a plurality of gas channels comprising gaps between a plurality of nested electrode portions having shapes defined by bounding frustoconical surfaces.

BRIEF DESCRIPTION OF THE DRAWINGS

The above noted and various other aspects of the present invention will become apparent from the following description which is given by way of example only and with reference to the accompanying drawings, not drawn to scale, in which.

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended figures taken in conjunction with the following description.

Figure 4A:
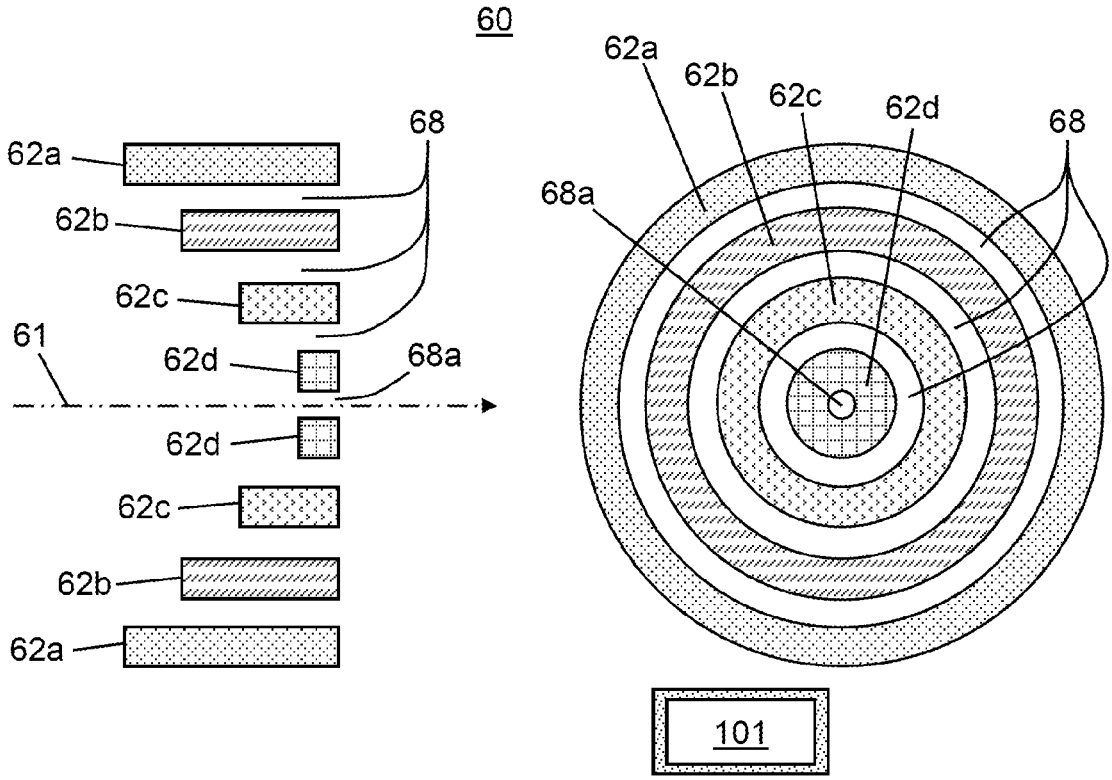
FIGS. 4A-4B are pairs of schematic cross sectional diagrams of a first ion transport apparatus in accordance with the present teachings.
Figure 4B:
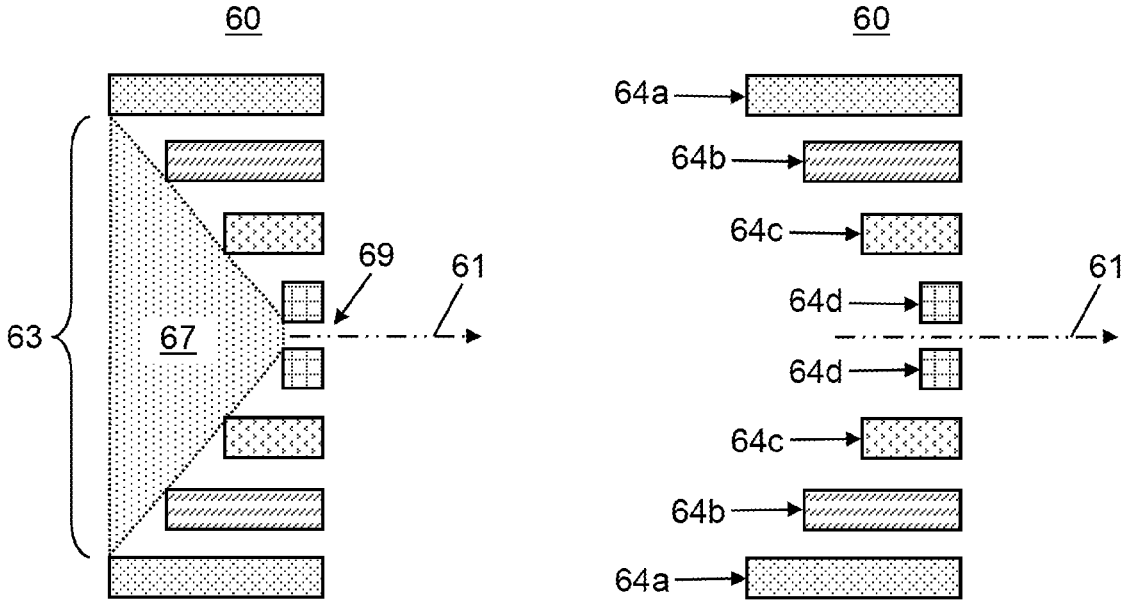

FIGS. 4A-4B provide schematic illustrations of a first ion transport apparatus in accordance with the present teachings. The ion transport apparatus 60 illustrated in FIG. 4A comprises a plurality of nested coaxially disposed tubular circularly-cylindrical electrodes. In the example shown in FIGS. 4A-4B, four such tubular electrodes are shown comprising an outer tubular electrode 62*a*, a second tubular cylindrical electrode 62*b* disposed coaxially with and interiorly with regard to the outer tubular electrode 62*a*, a third tubular cylindrical electrode 62*c* disposed coaxially with and interiorly with regard to the second tubular electrode 62*b*, and an inner tubular electrode 62*d* disposed coaxially with and interiorly with regard to the third tubular electrode 62*c*. The leftmost diagram of each of FIGS. 4A-4B is a longitudinal cross sectional view through the apparatus. The rightmost diagram of each of FIGS. 4A-4B is a projected view of the apparatus along the axis 61 and in the direction of the arrow noted on that axis. Although four electrodes are shown in FIGS. 4A-4B and in other instances of the accompanying drawings, the number of electrodes is not intended, in any instance, to be restricted or limited to any particular number of electrodes.

Figure 1A:
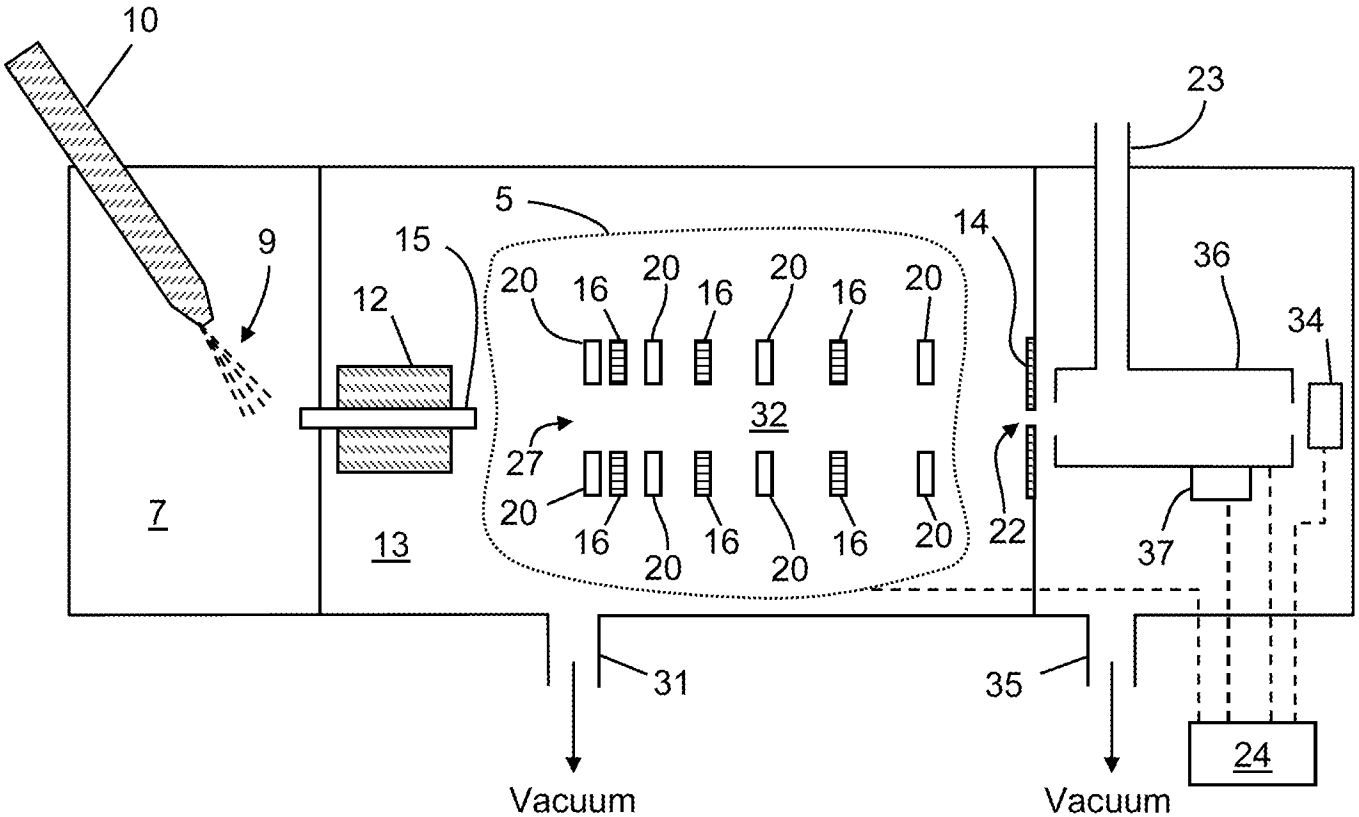
FIG. 1A is a schematic depiction of a first mass spectrometer system in conjunction with which various embodiments in accordance with the present teachings may be practiced.
Figure 1B:
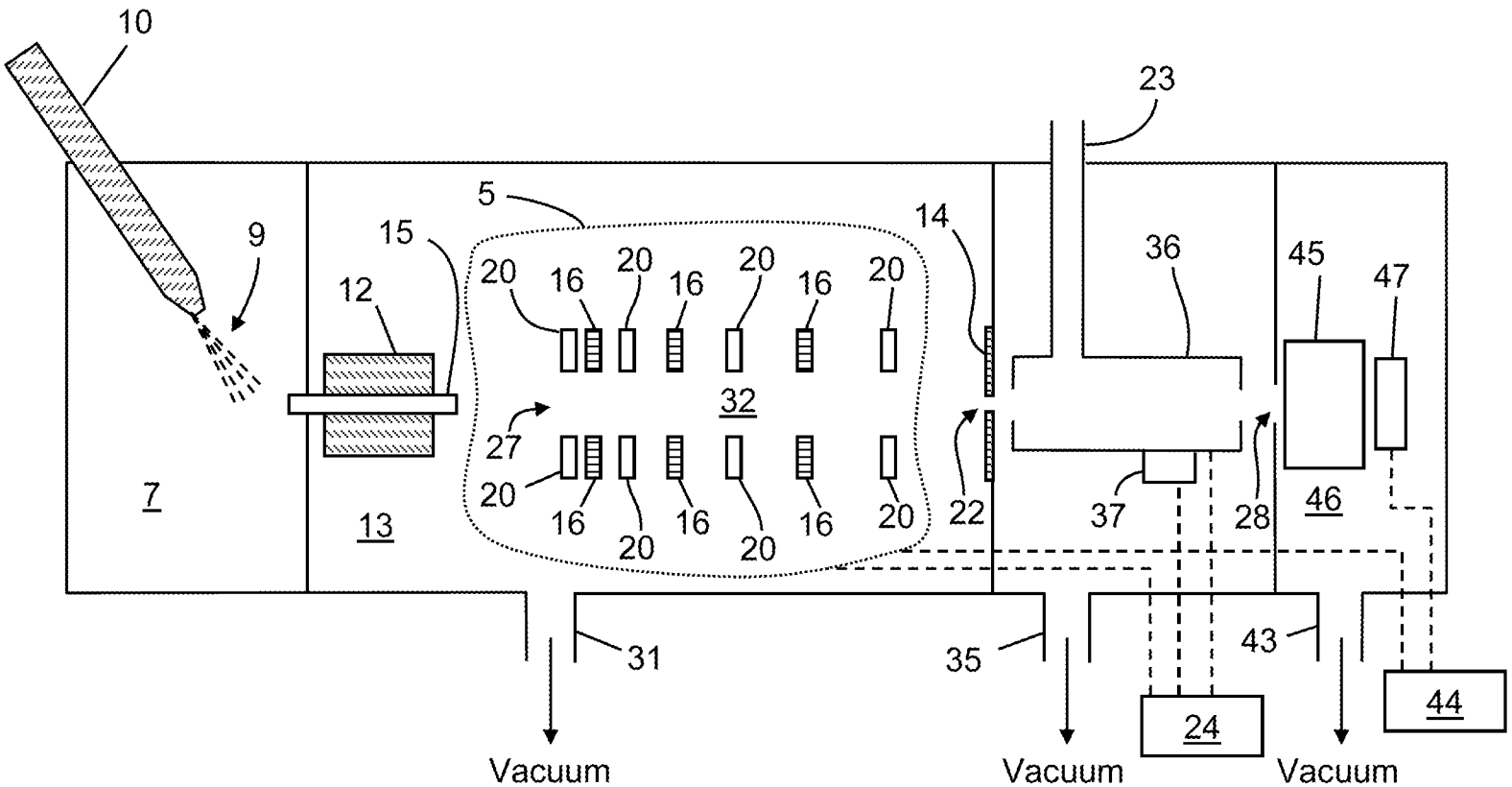
FIG. 1B (Prior Art)
FIG. 1B is a schematic depiction of a second mass spectrometer system in conjunction with which various embodiments in accordance with the present teachings may be practiced.
Figure 2A:
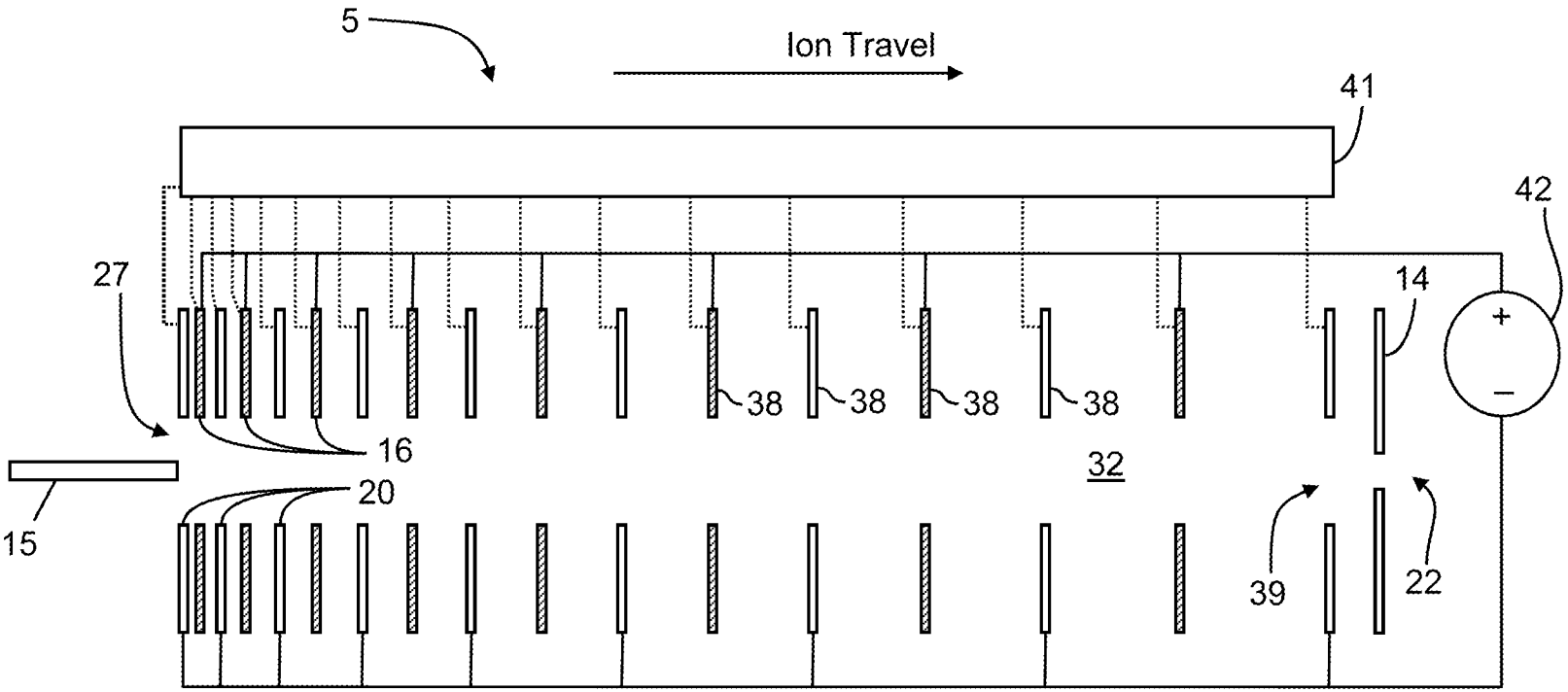
FIG. 2A (Prior Art)
FIG. 2A is a cross-sectional depiction of a stacked-ring ion guide (SRIG) ion transport device used in the mass spectrometer systems of FIG. 1.
Figure 2B:
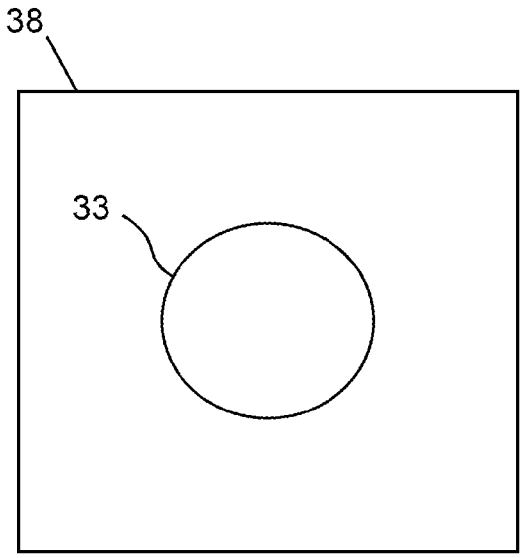
FIG. 2B (Prior Art)
FIG. 2B is a diagram of a single ring electrode of the SRIG ion transport device of FIG. 2A.

Axis 61 is the common axis of the plurality of tubular electrodes 62*a*-62*d*. The apparatus 60 has an entrance 63 at which gas and charged particles (primarily ions) enter the apparatus and an ion exit 69 along axis 61 at which charged particles (primarily ions) exit the apparatus in the direction of the arrow indicated on axis 61. The entrance 63 is defined by the bore of the outer electrode 62*a* at an end of that electrode that faces an ion source (not shown) whose position is to the left of the leftmost diagrams of FIGS. 4A-4B. Power supply 101 applies RF voltages to the electrodes and, optionally, DC voltage offsets between adjacent electrodes so as to cause the trajectories of the charged particles to converge towards the central axis 61 within an internal ion transport and convergence region 67. The ion convergence region 67 is defined by the set of ends 64*a*-64*d* of the tubular electrodes that face the ion source. Each such end, other than the end of the outer tubular electrode 62*a*, is recessed within the interior of the adjacent enclosing electrode as illustrated in FIGS. 4A-4B. Thus, with regard to the set of ends of the tubular electrodes that face the ion source, each such end of each progressively inward electrode is recessed with regard to the comparable end—that is, the end facing the ion source—of the immediately enclosing electrode. This configuration gives rise to a funnel shaped ion transport and convergence region 67 with the diameter of the funnel narrowing in the direction from the entrance 63 to the exit 69. The exit 69 of the apparatus 60 is adjacent to and aligned with the aperture 22 of extraction lens 14 (see FIGS. 1A-1B) such that the charged particles (primarily ions) pass through the aperture into a lower-pressure chamber.

The co-axial tubular electrodes 62*a*-62*d* are nested in a fashion such that a series of annular gaps 68 exist between pairs of adjacent electrodes. Although ions and possibly other charged particles are caused to converge towards the central axis by the application of voltages applied to the electrodes, the gas jet that comprises neutral gas molecules emerging from the ion source (not shown) undergoes rapid expansion during its entry into and passage through the apparatus 60. The jet expansion causes the majority of neutral gas molecules to diverge away from the central axis 60 so as to be intercepted by and exit the apparatus through one of the annular gaps 68. The annular gaps 68 are not aligned with the aperture 22 of extraction lens 14 (see FIGS. 1A-1B) and thus gas that exits through the gaps 68 is primarily exhausted through vacuum port 31 and is thus separated from the ions.

The configuration of the electrodes of the apparatus 60 is such that most of the gas can escape through the annular gaps 68 without impinging upon an electrode surface at a high angle. Electrically insulating spacers (not shown) may be placed within the annular gaps so as to maintain the relative dispositions of the tubular electrodes. The size and positioning of such spacers may be chosen so as to minimize blocking of the gas flow through the annular gaps. Although a small amount of gas may exit together with ions through the lumen 68*a* of the innermost tubular electrode 62*d*, the quantity of gas that exits in this fashion may be minimized by maintaining a small diameter of the lumen 68*a*. The electrode configuration of the ion transport apparatus 60 thus inhibits buildup of gas pressure within the apparatus.

Figure 4C:
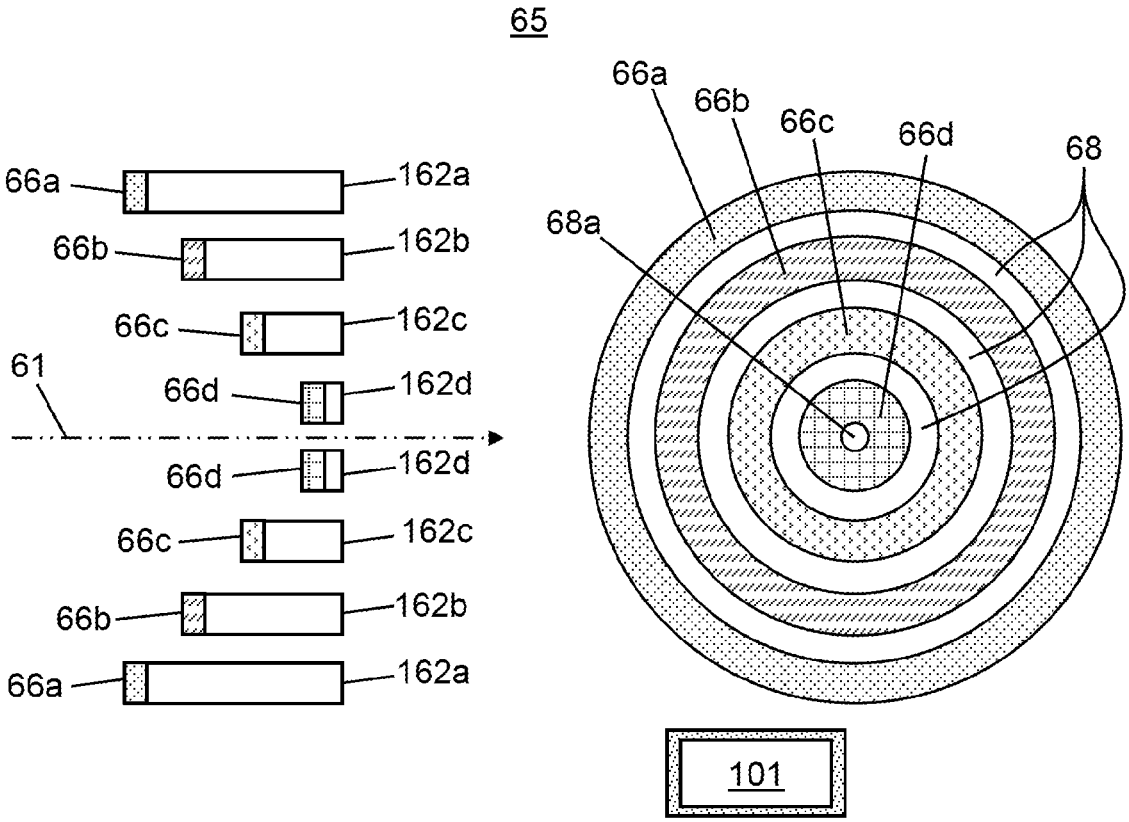
FIG. 4C is a schematic cross sectional diagram of another ion transport apparatus in accordance with the present teachings that is a variation of the apparatus represented in FIGS. 4A-4B.

As illustrated in FIGS. 4A-4B, each one of the electrodes 62*a*-62*d* is a tube. However, it is not necessary for each tube to be wholly composed of electrically conductive electrode material. For example, in some embodiments, the electrode portions may comprise electrically conductive coatings on tubes formed of electrically insulating material. For example, in the ion transport apparatus 65 illustrated in FIG. 4C, electrically insulating tubes 162*a*-162*d* are disposed similarly to the disposition of tubular electrodes 62*a*-62*d* shown in FIGS. 4A-4B. Accordingly, annular gaps 68 are defined between tubes 162*a*-162*d* (FIG. 4C) in the same fashion that such gaps are formed between tubular electrodes 62*a*-62*d* (FIGS. 4A-4B), thereby allowing escape of gas through the annular gaps in the same fashion as discussed above. Note that the leftmost diagram of FIG. 4C is a longitudinal cross sectional view through the apparatus and the rightmost diagram is a projected view of the apparatus along the axis 61 in the direction of the arrow. However, the plurality of electrodes of the of the ion transport apparatus 65 comprise a plurality of electrode members 66*a*-66*d*, such as plates, rings or coatings, that are attached to or affixed to the tubes 162*a*-162*d*. Thus, the electrode members 66*a*-66*d* are supported at the ends of the tubes that face the ion source (not shown) whose position is to the left of the leftmost diagram of FIG. 4C. The tubes may support electrical leads (not shown) that are electrically coupled to the electrode members so that the appropriate RF and DC voltages may be applied to the electrode members. As in the apparatus 60 (FIGS. 4A-4B), these applied voltages cause charged particles (primarily ions) to migrate to the central axis 61 and to exit through the lumen 68*a* of the innermost tube 162*d*. The design shown in FIG. 4C produces reduced-capacitance apparatus relative to conventional ion funnel devices thereby reducing the performance requirements and cost of an RF power supply to which the apparatus is electrically coupled.

Figure 5:
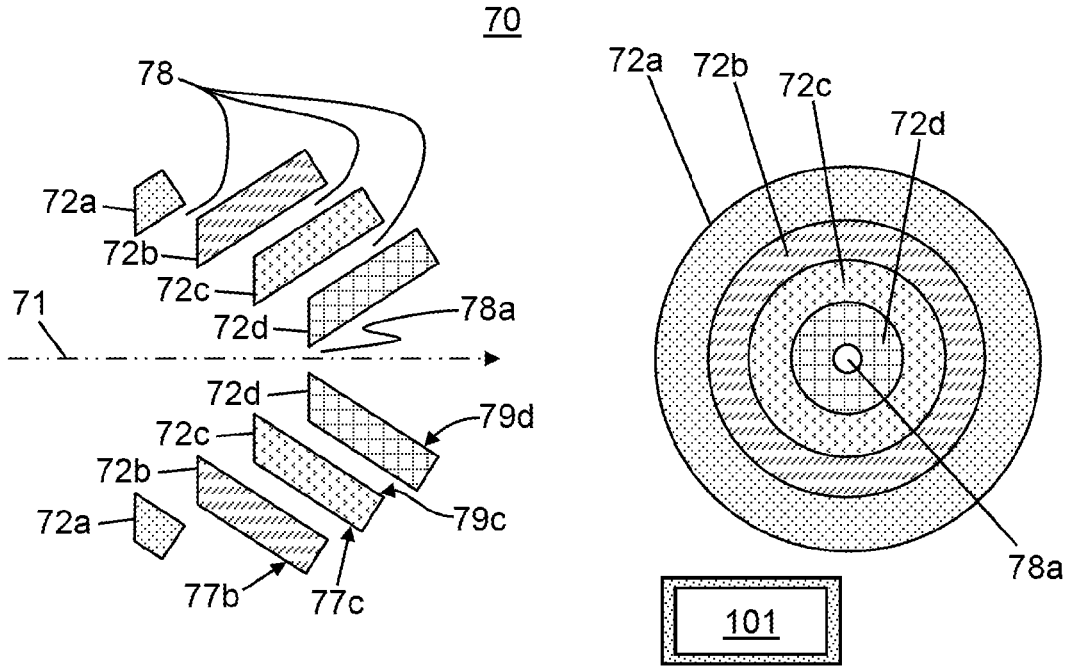
FIG. 5 is a pair of schematic cross sectional diagrams of a second ion transport apparatus in accordance with the present teachings.

FIG. 5 provides schematic illustrations of another ion transport apparatus—ion transport apparatus 70—in accordance with the present teachings. Similarly to each of FIGS. 4A-4C, the leftmost diagram of FIG. 5 is a longitudinal cross sectional view through the apparatus 70 and the rightmost diagram is a projected view of the apparatus 70 along the central axis 71 of the apparatus as viewed in the direction of the arrow. In contrast to the previously-described ion transport apparatus 60 (FIGS. 4A-4B), the electrodes 72*a*-72*d* of the ion transport apparatus 70 are not in the form of cylindrical tubes but, instead, take the form of nested truncated right-circular cones, the truncated narrow portions of the cones facing the ion source (not shown) which is at the left side of the leftmost diagram of FIG. 5. More specifically, each of the electrodes 72*a*-72*d* is bounded by a respective outer surface (e.g., outer surfaces 77*b* and 77*c* as well as corresponding surfaces on other instances of the electrodes) and a respective inner surface (e.g., inner surfaces 79*c* and 79*d* as well as corresponding surfaces on other instances of the electrodes), with each of the outer and inner surfaces comprising a frusto-conical surface. The central axis 71 is the axis of radial symmetry of each of the truncated conical electrodes. Power supply 101 applies RF voltages to the electrodes and, optionally, DC voltage offsets between adjacent electrodes so as to cause the trajectories of the charged particles to converge towards the central axis 71 and the orifice 78*a*.

Still referring to FIG. 5, the innermost electrode 72*d* of the apparatus 70 has the orifice 78*a* at its truncated end which is centered on the axis 71 and which serves as an ion exit for the apparatus. The innermost truncated conical electrode is nested within truncated conical electrode 72*c* which is in the form of a similar truncated right-circular cone that is truncated so as to have an opening at its truncated end that is wider than the orifice 78*a* of truncated conical electrode 72*d*. Likewise, the truncated conical electrode 72*c* is nested within truncated conical electrode 72*b* which is itself nested within truncated conical electrode 72*a*. This configuration of truncated conical electrodes defines a funnel shaped ion convergence region within the interior of the apparatus that is similar to the region 67 shown in FIG. 4B. Further, since the cones have similar angular conical apertures, a series of gaps 78 is defined between the cones. Accordingly, expanding gas emerging from an ion source (not shown) can easily be intercepted by the gaps and exhausted from the apparatus.

As in the apparatus 60 (FIGS. 4A-4B), RF and DC voltages applied to the electrodes cause charged particles (primarily ions) to migrate to the central axis 71 and to exit through the orifice 78*a* of the innermost electrode 72*d* thereby providing efficient separation of the charged particles from the gas. Similarly to the construction of the apparatus 65 (FIG. 4C), the electrodes may alternatively be provided as conductive coatings on the truncated ends of the truncated cones, where the truncated cones are formed, in this alternative case, of electrically insulating material. In such a case, each electrode is supported on a respective one of the truncated cone structures, the supporting structure being bound by frustoconical inner and outer surfaces. The truncated cone structures may be formed by the technique of additive manufacturing (commonly known as "3D printing") in which successive layers of material are laid down in different shapes with regard to different layers.

Figure 6:
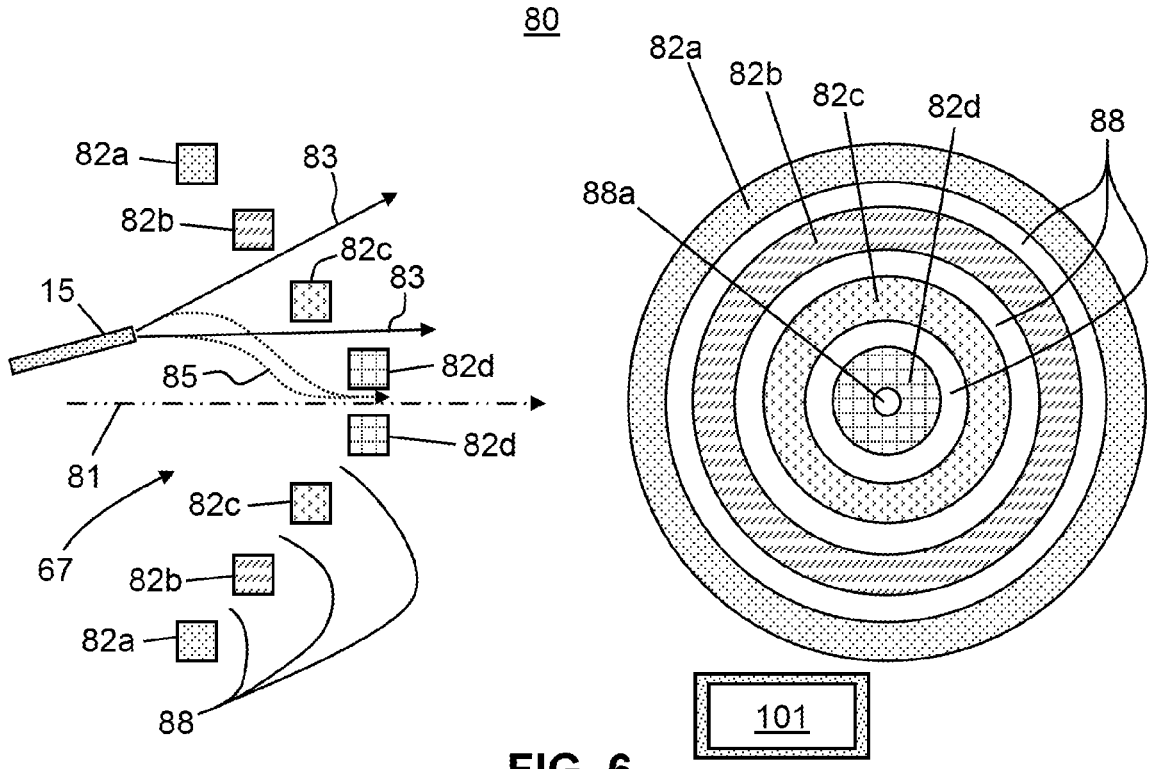
FIG. 6 is a pair of schematic cross sectional diagrams of a generalized ion transport apparatus in accordance with the present teachings.
Figure 7A:
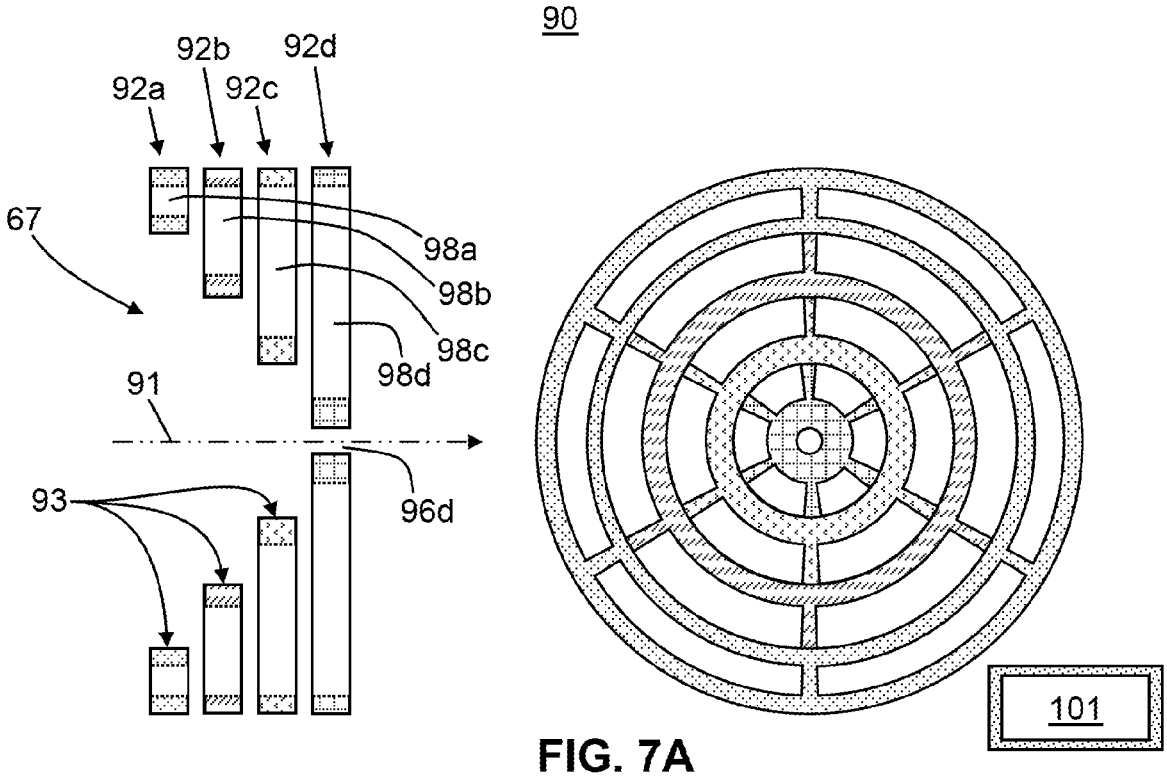
FIG. 7A is a pair of schematic cross sectional diagrams of another ion transport apparatus in accordance with the present teachings.
Figure 7B:
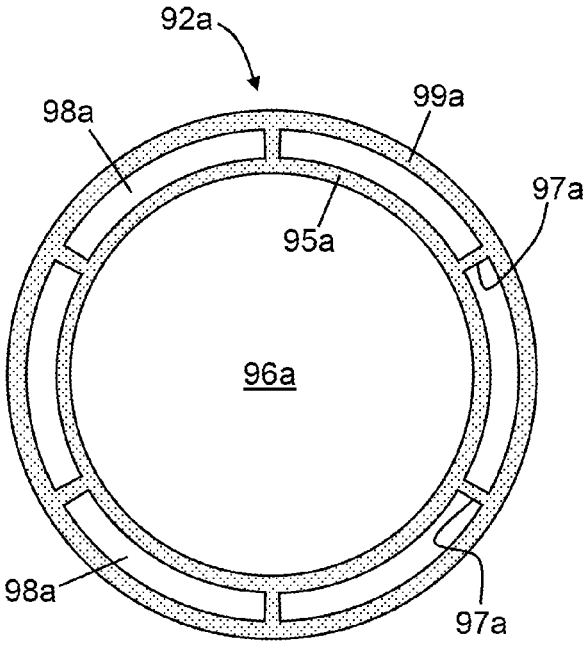
FIGS. 7B-7E are respective depictions of four separate electrode structures or electrode-bearing structures included in the ion transport apparatus of FIG. 7A.
Figure 7C:
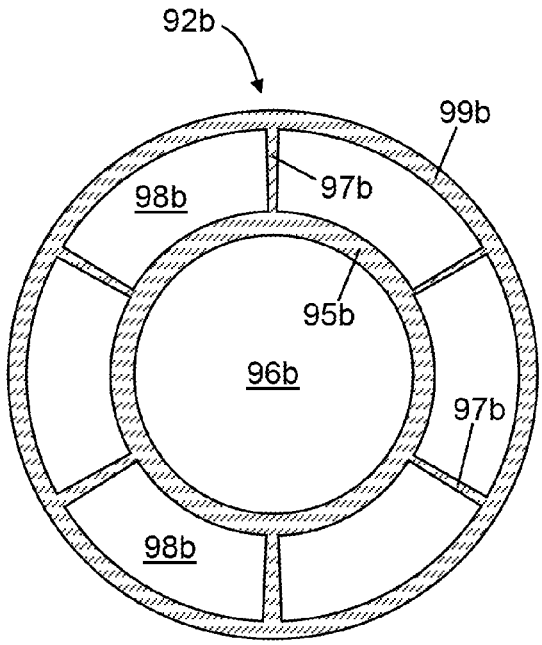
Figure 7D:
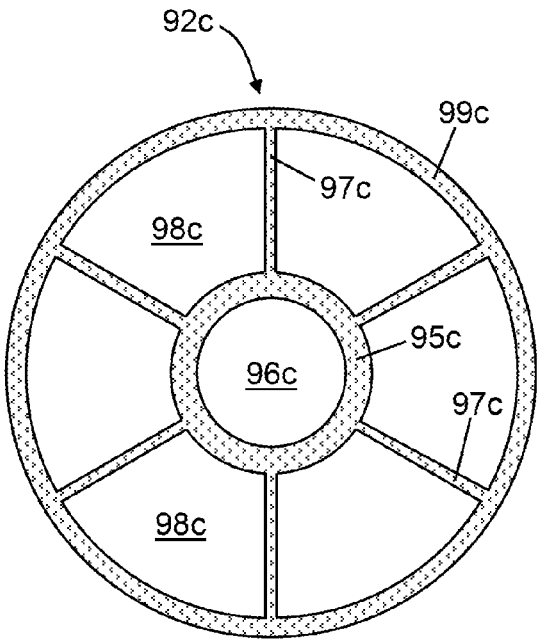
Figure 7E:
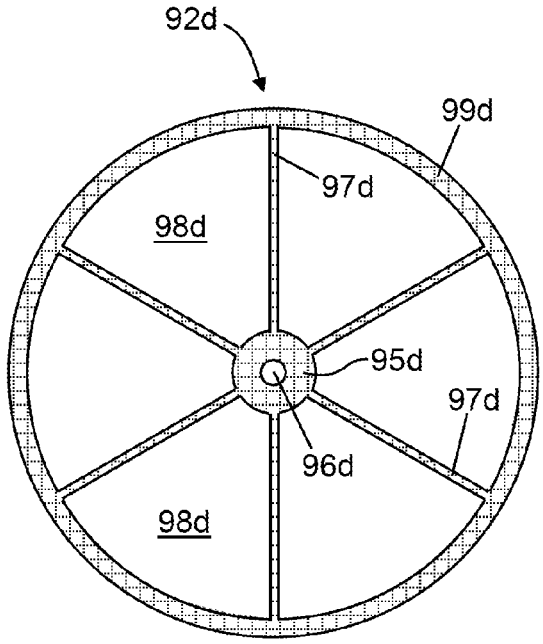

As implied by the discussions above, many different configurations are consistent with the instant teachings. For example, FIG. 6 provides a schematic illustration of a generalized apparatus in accordance with the present teachings that is consistent with many various different physical support structure configurations and is not specifically restricted to any particular such configuration. As in the previously described drawings, the leftmost diagram of FIG. 6 is a longitudinal cross sectional view through the generalized apparatus 80 and the rightmost diagram is a projected view of the apparatus 80 along the central axis 81 of the apparatus as viewed in the direction of the arrow on that axis. FIG. 6 also illustrates an ion transfer tube 15 (or, possibly, an ion source) as well as a generalized schematic pathway 85 of ions through the apparatus and a generalized schematic pathway 83 of gas through the apparatus.

The apparatus 80 of FIG. 6 is shown as comprising four electrodes—electrodes 82*a*, 82*b*, 82*c* and 82*d*—although, in a more general sense, the apparatus 80 comprises a plurality of electrodes which is not intended to be restricted or limited to any specific number of electrodes. In FIG. 6, the electrodes are shown as having a circular face or as having a circular projection in transverse cross section (e.g., such as ring electrodes or cylindrical electrodes) but the present teachings are not intended to be limited to such embodiments. For example, the electrodes could present a polygonal face in transverse cross section or could comprise a plurality of segments. Power supply 101 applies RF voltages to the electrodes and, optionally, DC voltage offsets between adjacent electrodes so as to cause the trajectories of the charged particles to converge towards the central axis 81 as is schematically illustrated by ion trajectories 85. The plurality of electrodes may be divided into a plurality of first electrodes (for example, electrodes 82*a* and 82*c* of FIG. 6) that are interleaved with a plurality of second electrodes (for example, electrodes 82*b* and 82*d* of FIG. 6), with the first electrodes receiving an oscillatory voltage that is opposite in phase with respect to the oscillatory voltage applied to the second electrodes.

A set of faces of the electrodes 82*a*-82*d* of the apparatus 80 are configured so as to define a funnel-shaped ion transport and convergence region 67 (see also FIG. 4B) such that the diameter of the funnel becomes narrower in the general direction from the ion entrance to the ion exit of the apparatus, i.e., in the direction f the arrow indicated on axis 81. The ion exit coincides with a lumen or aperture 88*a* in the electrode that is closest to the axis (electrode 82*d* in the illustrated example). It is understood that the lumen or aperture 88*a* is disposed in alignment with and adjacent to an aperture (e.g., the aperture 22 shown in FIG. 1) that leads the ions into a lower-pressure chamber after the ions pass through the lumen or aperture 88*a*. The electrodes are further configured such that a plurality of open gaps 88 is defined between pairs of adjacent electrodes. By contrast, the gaps 88 are not adjacent to or aligned with the aperture that leads into the lower pressure chamber.

During operation of the ion transport apparatus 80, gas comprising neutral molecules emerges from the exit end of the ion transfer tube 15 or other entrance orifice. In many situations, the ion-laden gas may emerge from the ion transfer tube or orifice as an expanding jet that generally expands outward in many directions across a range of angles. The expansion may be axisymmetric about an extension of the axis of the ion transfer tube, if the tube comprises a simple bore that is circular in cross section. However, if the tube bore comprises a different shape—such as a "letterbox" or arcuate shape—or comprises multiple such bores, then the gas expansion will be generally non-isotropic. Two representative gas trajectories are indicated as gas flow paths 83 in FIG. 6. As a result of this expansion and the configuration of the electrodes, most of this gas encounters one or more of the gaps 88 and is exhausted from the apparatus through these gaps. Preferably, the ion transfer tube 15 is slightly angularly misaligned with the apparatus axis 81 such that there does not exist a direct line of sight from the exit end of the ion transport tube 15 to the lumen or aperture 88*a* (note that the angular mis-alignment is exaggerated in FIG. 6). As a result of this slight mis-alignment, there is no un-impeded gas molecule trajectory from the ion transfer tube 15 to the aperture (not-illustrated) leading to the lower pressure chamber. The gas that exhausts through gaps 88 also does not directly encounter this aperture. Consequently, a very high proportion of the gas is prohibited from being transported into the lower-pressure chamber and is thus removed from the chamber containing the ion transport apparatus (e.g., chamber 13 in FIG. 1) by an evacuation port (e.g., vacuum port 31) associated with that chamber.

As similarly noted above with regard to conventional ion funnel devices, if the ion-laden gas from an ion source emerges into an ion transport apparatus as a high-velocity and rapidly expanding jet, then it is desirable to provide a minimum lateral distance between the end of the ion transfer tube or orifice 15 and the electrodes according to the present teachings (e.g., electrodes 82*a*-82*d* as shown in FIG. 6, electrodes 62*a*-62*d* shown in FIGS. 4A-4B, electrodes 72*a*-72*d* as shown in FIG. 5, etc.) so that the initial high velocity of the emerging gas may be sufficiently dampened by collisions with background gas such that the trajectories of the ions may be manipulated independently of the gas flow. In the case of ion transfer tubes having counterbored exit ends (see for example U.S. Pat. No. 8,242,440 to Splendore et al.) where the beam velocity is greater than it would otherwise be using conventional ion transfer tubes, the minimum distance required would be correspondingly larger.

In accordance with the above considerations, the proximity of the ion transfer tube 15 to the electrodes 82*a*-82*d* as shown in FIG. 6 should be regarded as schematic only. In practice, it may be necessary to extend the distance—beyond what is depicted in the accompanying drawings—between the ion transfer tube or aperture and the electrodes fashioned in accordance with the present teachings in order to satisfy a requirement for a minimum lateral distance. At the practical operating pressures of these devices in the 0.5-10 Torr range, this minimum lateral distance has found experimentally by the inventors to be in the range 55-80 mm. The extra distance may be provided by providing, within the novel ion transport apparatuses of the present teachings, additional electrode members or electrode plates between the ion transfer tube or orifice and the illustrated electrodes. The additional electrode members or electrode plates may be formed so as to provide a passageway for the ions in which the ions may lose kinetic energy through collisions with background gas. The additional electrode members or plates may be fashioned in the form of a conventional ion transport device such as, for example, a stack of mutually-similar, apertured electrode plates (e.g., ring electrodes) wherein RF voltages of different phases are applied to the electrode members or electrode plates. Such configurations are known, for example, in conventional stacked-ring ion guides or, possibly, as are configured in the ion transport device 5 shown in FIG. 1. Note that this optional conventional set of untapered electrodes is not depicted in the accompanying figures.

In contrast to the generalized or average gas molecule trajectories discussed above, the ion trajectories 85 are caused to generally converge towards the central axis by the action of RF and possibly DC voltages applied to the electrodes 82*a*-82*d*. The applied DC voltages may also aid in the transport of ions in the general direction of the arrow indicated on the central axis 81. Consequently, a large proportion of the ions are caused to pass through the lumen or aperture 88*a* of the innermost electrode 82*d*. Thus, these ions are efficiently separated from neutral gas molecules and are transported into the lower-pressure chamber.

Figure 3:
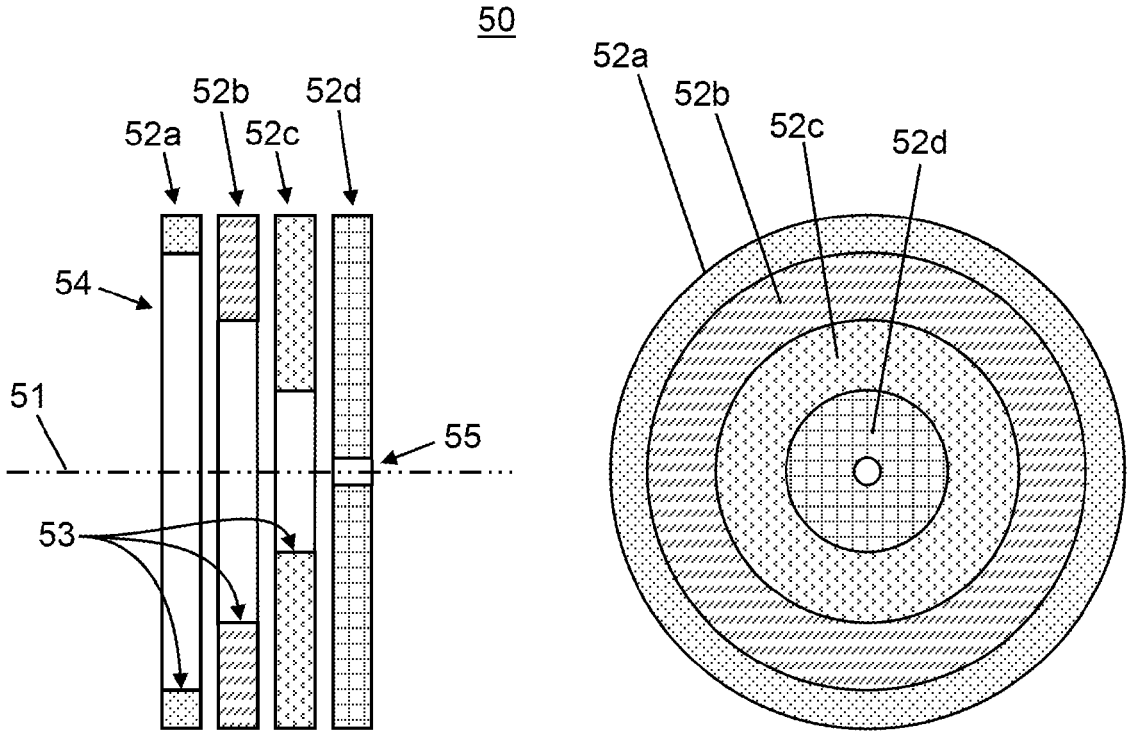
FIG. 3 (Prior Art)
FIG. 3 is a pair of schematic cross sectional diagrams of a prior-art ion funnel apparatus.

FIG. 7 illustrates another embodiment of an ion transport apparatus in accordance with the present teachings and showing a specific example of the above-described general considerations. FIG. 7A provides a generalized depiction of the ion transport apparatus 90 with the leftmost diagram of FIG. 7A being a longitudinal cross sectional view through the apparatus 90 and the rightmost diagram of FIG. 7A being a projected view of the apparatus 90 along the central axis 91 of the apparatus as viewed in the direction of the arrow on that axis. The apparatus comprises a plurality of ring electrodes, not limited or restricted to any particular number of electrodes, which are illustrated by the four exemplary ring electrodes 92*a*-92*d*. Power supply 101 applies RF voltages to the ring electrodes and, optionally, DC voltage offsets between adjacent ring electrodes so as to cause the trajectories of the charged particles to converge towards the central axis 91. In similarity to general nature of ring electrodes 52*a*-52*d* (e.g., see FIG. 3) of conventional ion funnel apparatuses, the ring electrodes of the apparatus 90 each have a short dimension (i.e., a thickness) that is oriented substantially parallel to the central axis 91. In other words, the long dimension (or dimensions) of the various ring 92*a*-92*d* are oriented substantially perpendicular to the central axis 91.

In similarity to the nature of ring electrodes in conventional ion funnel apparatuses, each ring electrode has a central opening that is preferably circular in shape, such that the diameters of at least a subset of the various ring electrodes progressively decrease in a general direction from the ion entry to the ion exit of the apparatus. FIGS. 7B, 7C, 7D and 7E illustrate the individual ring electrodes 92*a*, 92*b*, 92*c* and 92*d*, respectively. The respective central openings are illustrated as openings 96*a*, 96*b*, 96*c* and 96*d*. The inner faces 93 (see FIG. 7A) of these various central openings define a funnel-shaped ion transport and convergence region 67 within the apparatus 90. The central opening of the first ring 92*a* (the largest-diameter opening) defines the ion entry of the apparatus 90 and the central opening 96*d* of the last ring 92*d* (the smallest-diameter opening) defines the ion exit of the apparatus.

Each of the ring electrodes 92*a*-92*d* of the novel apparatus 90 includes additional apertures that are separated from the respective central opening so as to define an inner ring between the central opening and the additional apertures. This configuration is illustrated in FIGS. 7B, 7C, 7D and 7E in which the additional apertures are indicated as apertures 98*a*, 98*b*, 98*c* and 98*d*, respectively and in which the central rings are indicated as central rings 95*a*, 95*b*, 95*c* and 95*d*, respectively. The presence of the apertures 98*a*-98*d* further defines outer rings which are indicated as outer rings 99*a*, 99*b*, 99*c* and 99*d* in FIGS. 7B, 7C, 7D and 7E, respectively. The central rings may be physically supported by and connected to the outer rings by spoke portions 97*a*, 97*b*, 97*c* and 97*d*. The sizes of the additional apertures 98*a*-98*d* of at least a subset of the various ring electrodes progressively increase in a general direction away from the ion entry of the apparatus. The progressive size increase of the apertures 98*a*-98*d* occurs through progressive extension of these apertures further towards the central axis 91 as ring electrodes progressively closer to the ion exit are considered and is accommodated by the simultaneous size decrease of the central openings in the same direction. This progressive size increase of the apertures 98*a*-98*d* enables these apertures to intercept a large portion of the diverging gas molecule trajectories within the apparatus.

Each ring electrode may be fabricated as a single integral piece formed of a conductive material (e.g., a metal) by drilling, cutting or punching out the central openings and additional apertures from, by way of non-limiting example, preexisting coin-shaped circular metal blanks. Alternatively, each of the ring electrodes may be fabricated from an electrically insulating material with only certain portions having an electrically conducting coating (e.g., a metal coating) thereon. In various embodiments, the conductive coating may occupy only the central ring portions 95*a*-95*d* with additional conductive coatings on portions of the spokes 97*a*-97*d* and outer rings 99*a*-99*d*, these additional conductive coatings serving as electrical leads to the various coated central rings. Alternatively, one or more of the central ring portion, outer ring portion or spoke portions may be formed from a different material from the other portions.

In operation of the ion transport apparatus 90, RF and possibly DC voltages are applied to the center ring portions 95*a*-95*d* of the ring electrodes 92*a*-92*d* in known fashion so as to cause charged particles (primarily ions) provided from an ion source or ion transfer tube (not shown) to converge towards the central axis while also moving towards the ion exit 96*d* of the apparatus. The ions that pass through ion exit 96*d* are then focused into an aperture that leads into a lower pressure chamber, this aperture being adjacent to and aligned with the ion exit 96*d*. In contrast, gas comprising neutral gas molecules is intercepted by one or more of the apertures 98*a*-98*d*. This gas passes substantially unimpeded through the apertures 98*a*-98*d* so as to be exhausted from the apparatus into the chamber in which the ion transport apparatus is contained. This gas is then substantially removed by an evacuation port (e.g., vacuum port 31) associated with the chamber in which the ion transport apparatus 90 is contained. In this way ions are effectively separated from neutral gas molecules without buildup of gas pressure within the ion transport apparatus.

Figure 8A:
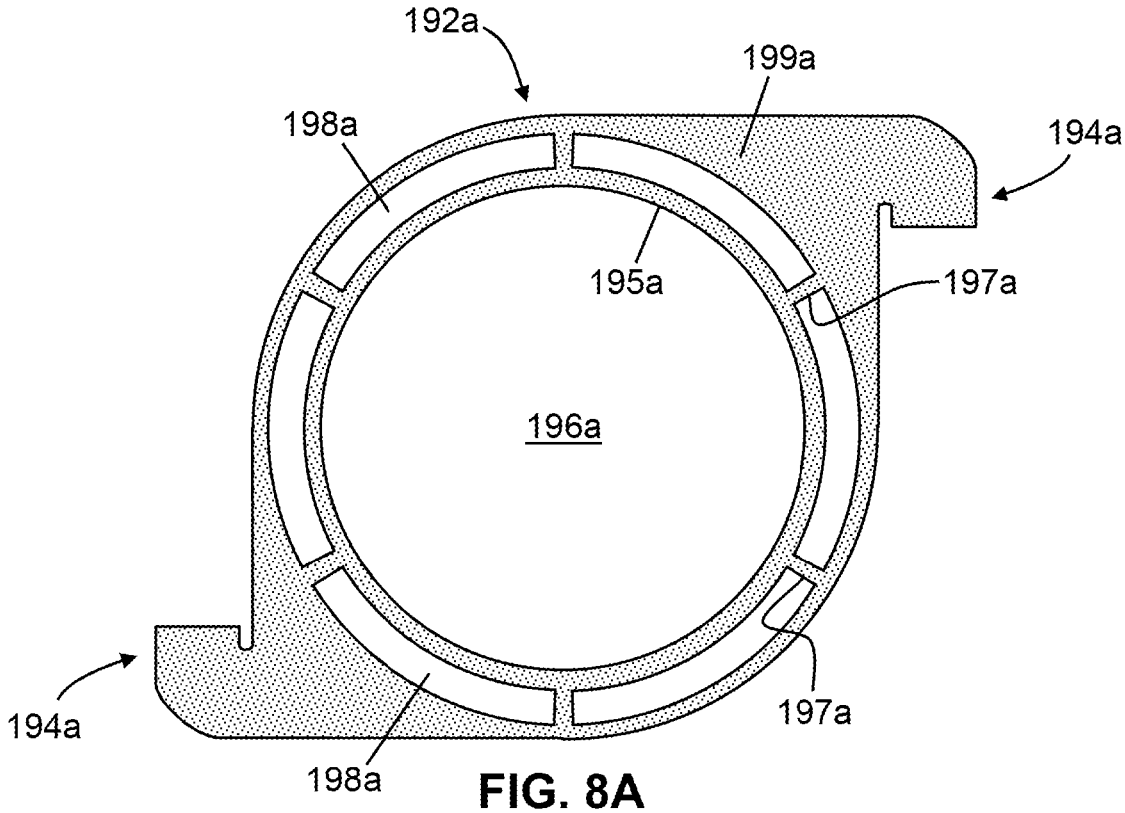
FIGS. 8A-8B are respective depictions of two separate electrode structures or electrode-bearing structures that may be included as part of an alternative set of such structures in the ion transport apparatus of FIG. 7A.
Figure 8B:
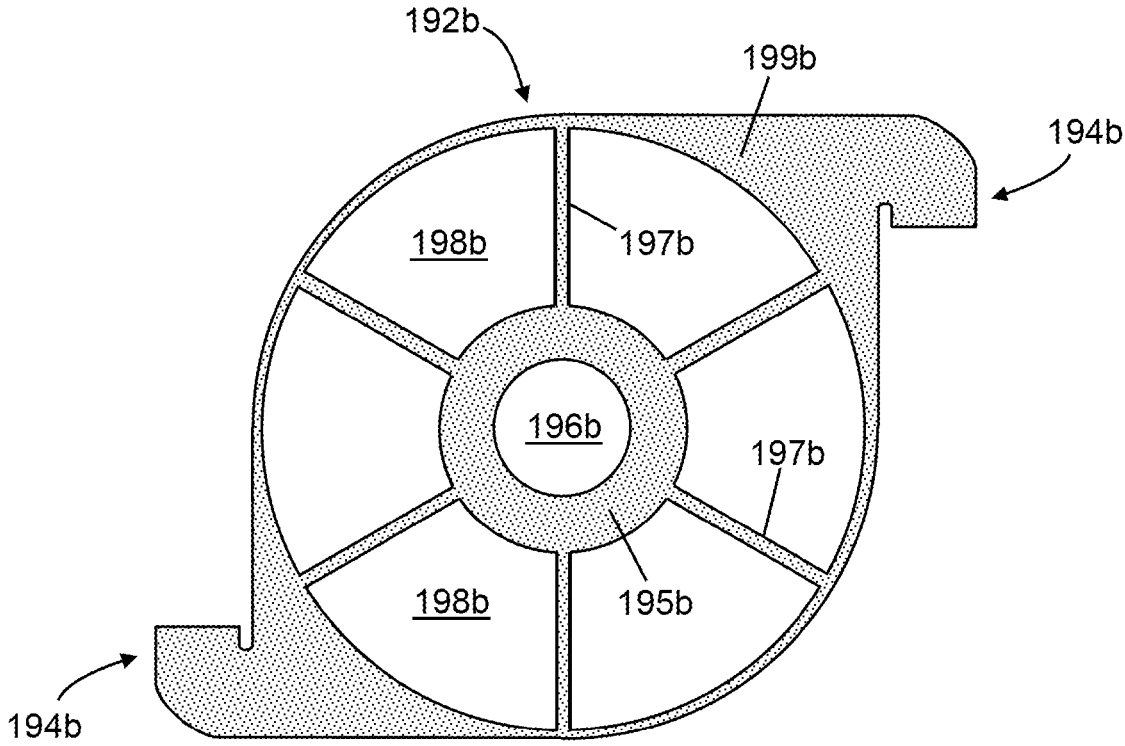

FIGS. 8A-8B are respective depictions of two separate electrode structures or electrode-bearing structures of an alternative set of such structures. The electrode plate structures 192*a*, 192*b* illustrated in FIGS. 8A-8B, may be considered as two examples of electrode plates which may be stacked, similarly to the stacking arrangement shown in FIG. 7*a*, within an ion transport apparatus in accordance with the present teachings. Such an ion transport apparatus will generally comprise a plurality of electrode plate structures, of which the two illustrated electrode plate structures 192*a*, 192*b* are representative. Within such an apparatus, the electrode plate structure 192*a* is positioned relatively closer to an ion entrance and the electrode plate structure 192*b* is positioned relatively closer to an ion exit. As described previously in regard to FIG. 7, the central apertures (central apertures 196*a*, 196*b* as well as corresponding apertures in other of the associated plurality of electrode plate structures) together form an ion channel through which ions are transmitted, with the diameter of the channel decreasing from the ion entrance to the ion exit. Also, as previously described in regard to FIG. 7, the other apertures (apertures 198*a* in FIG. 8A, apertures 198*b* in FIG. 8B as well as corresponding apertures in other of the associated plurality of electrode plate structures) are employed, in operation, to channel neutral gas molecules through the apparatus so that the gas may be exhausted from the ion transport apparatus spatially separated from the ions.

Each electrode plate structure (e.g., electrode plate structures 192*a*, 192*b*) may be formed as a single integral piece of an electrically conductive material, such as a metal. In such cases, the central apertures 196*a*, 196*b* and the other, outer apertures (other apertures 198*a* in FIG. 8A and 198*b* in FIG. 8B separated by respective spoke portions 197*a* and 197*b* and surrounded by outer rings 199*a*-199*b*, respectively) may cut out of a pre-form metal plate by any suitable mechanical, chemical, electrical, optical or electro-chemical machining technique, such as, by way of non-limiting example, by mechanical cutting, mechanical stamping, laser cutting, chemical etching, etc. As illustrated in FIG. 8, the plates may comprise integral tab structures (or other structures) that may be used for mounting each of the plurality of electrode plates within a respective slot of a housing member (not shown) of the ion transport apparatus. The tabs may also be additionally or alternatively employed as electrical connectors. For example, assuming that the each of the plates 192*a*, 192*b* comprises a single integral piece of metal, the tabs 194*a*, 194*b* may be folded around and welded to a respective electrical contact of the housing member.

A subset of a plurality of electrode plates adjacent to the ion exit of an ion transport apparatus in accordance with the present teachings may comprise a set of ring electrodes (e.g. ring electrode 195*b* in FIG. 8B) wherein these ring electrodes adjacent to the ion exit have a constant outer diameter among the subset of the plurality of plates. Within this subset, the widths of the ring electrodes increase in a direction towards the ion exit of the apparatus as the diameter of the central apertures become smaller at the same time that the ring electrode outer diameters (defined by the inner boundaries of the other apertures such as apertures 198*b*) remain constant. For example, the increase in the width of the ring electrodes may be noted by comparing the width of ring electrode 195*b* to that of ring electrode 195*a*. Such a configuration is advantageous for optimizing the separation of ion flow (through central apertures 196*a*, 196*b*, etc.) from the flow of gas (through the other apertures 198*a*, 198*b*, etc.) and thereby minimizing the transport of gas into the lower-pressure chamber into which the ions are directed after passing through the ion exit of the apparatus.

Figure 8C:
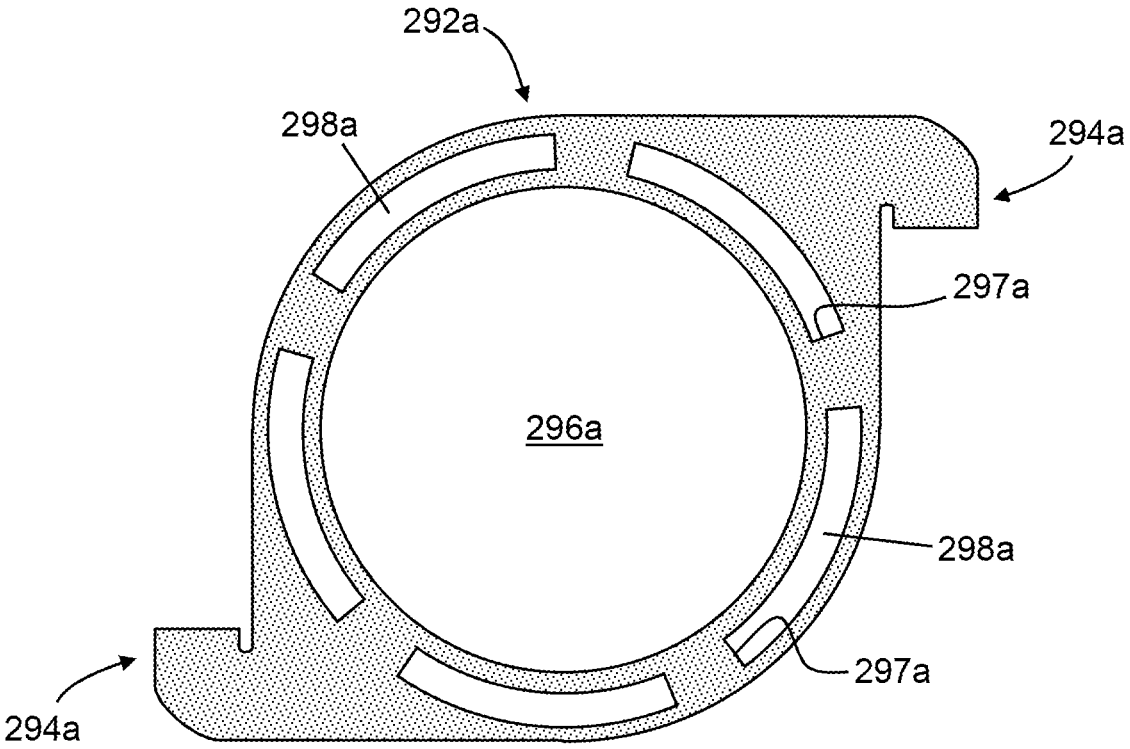
FIGS. 8C-8D are respective depictions of two separate electrode structures or electrode-bearing structures that may be included as part of a still further alternative set of such structures in the ion transport apparatus of FIG. 7A.
Figure 8D:
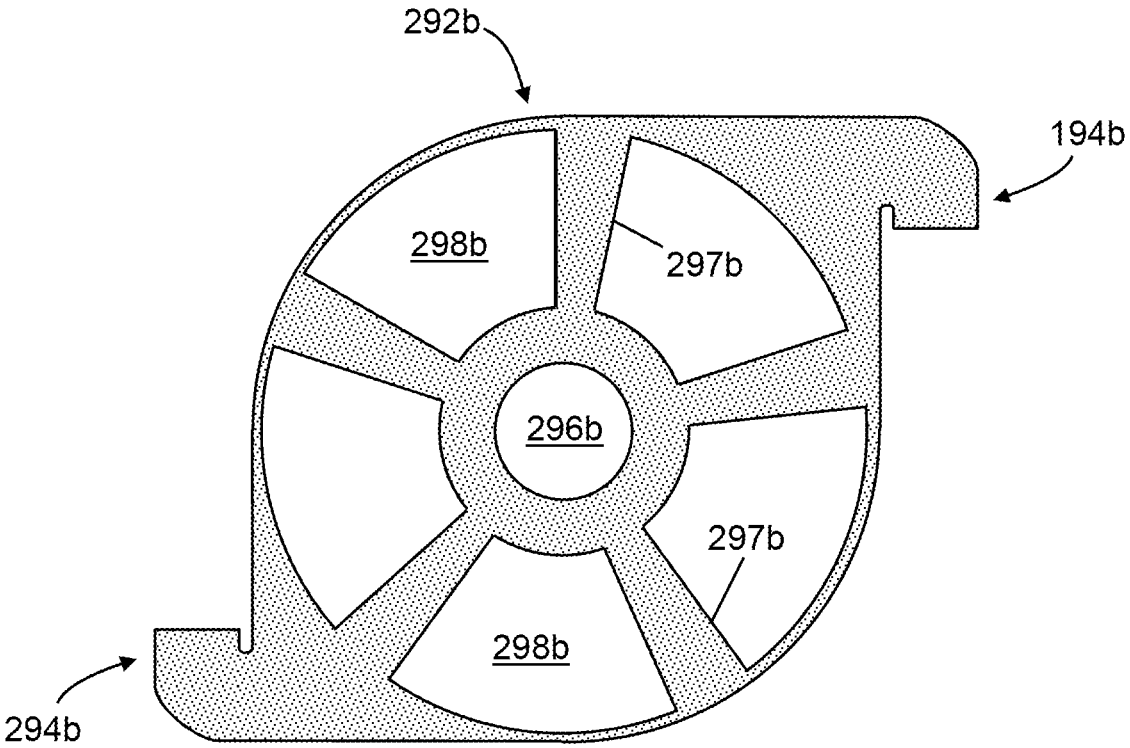
Figure 8E:
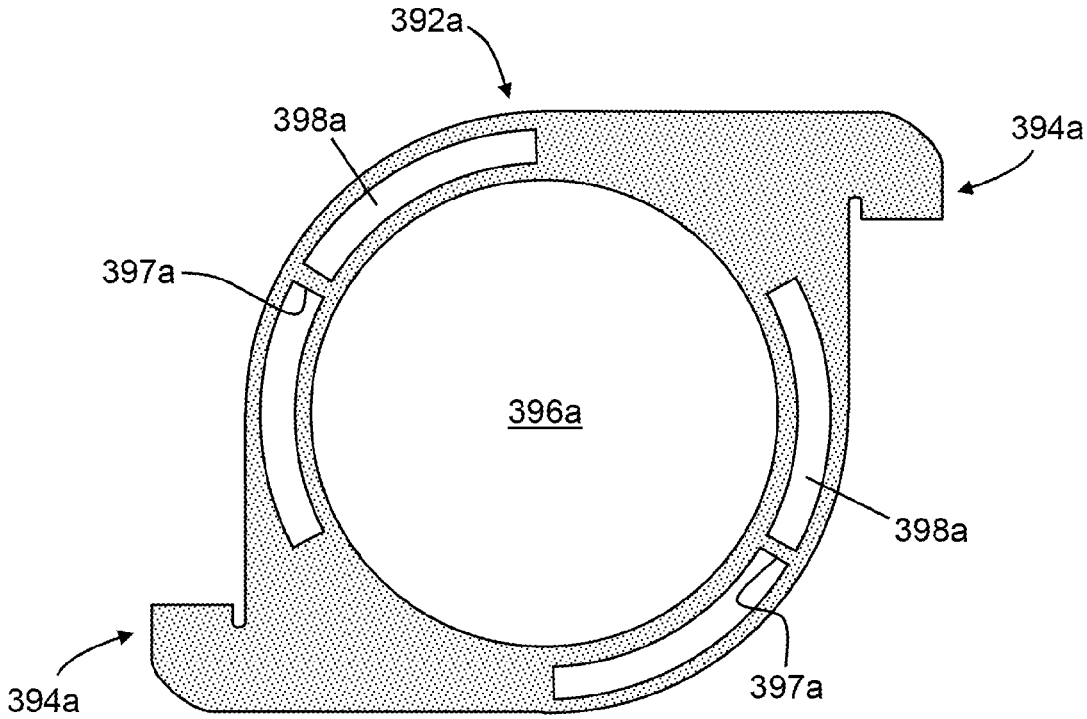
FIGS. 8E-8F are respective depictions of two separate electrode structures or electrode-bearing structures that may be included as part of a yet still further alternative set of such structures in the ion transport apparatus of FIG. 7A.
Figure 8F:
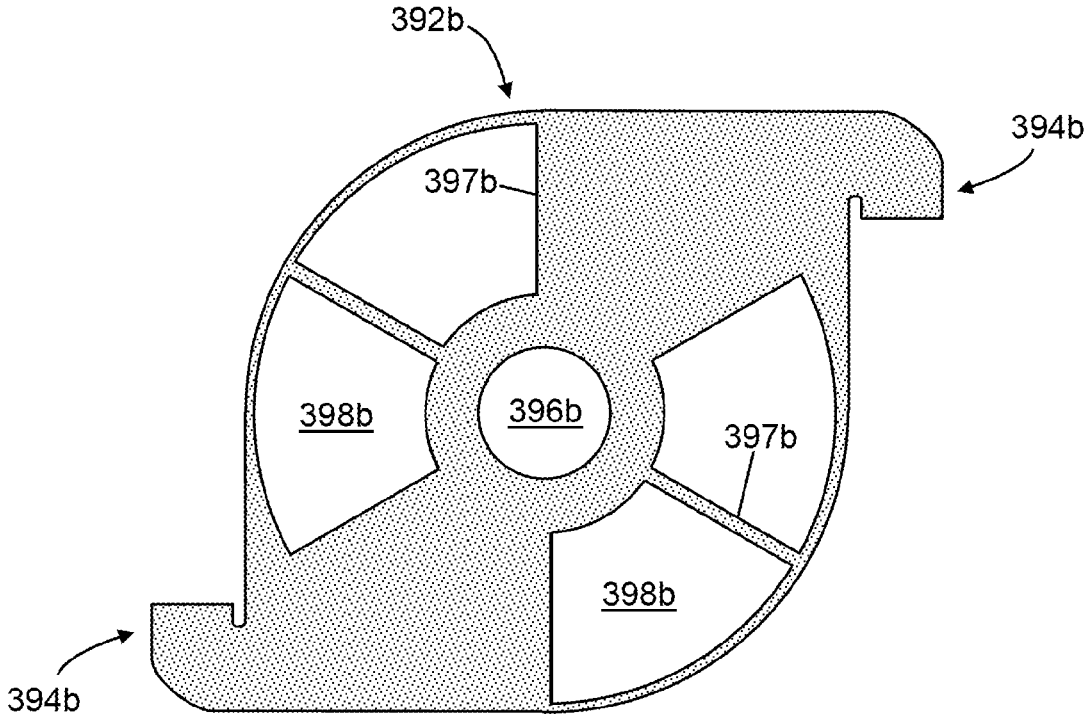

In alternative embodiments (for example, one embodiment as illustrated in FIGS. 8C-8D and another embodiment as illustrated in FIGS. 8E-8F), the outer apertures may occupy a smaller portion of the surface area of one or more of the electrode plate. The areal extent of the electrode plates occupied by the open outer aperture sections may be designed so as to fine tune (e.g., regulate) the conductance (or even the directionality of the conductance) of the gas perpendicular to the axis. For example, in FIGS. 8C-8D, two electrode plates 292*a*, 292*b* out of a set of plates are shown and in FIGS. 8E-8F, two electrode plates 392*a*, 392*b* out of an alternative set of plates are shown. The electrode plates 292*a*, 292*b* shown in FIGS. 8C-8D respectively comprise central apertures 296*a*, 296*b*, respectively comprise outer apertures 298*a*, 298*b*, respectively comprise spoke portions 297*a*, 297*b* and respectively comprise tab sections 294*a*, 294*b*. Similarly, the electrode plates 392*a*, 392*b* shown in FIGS. 8E-8F respectively comprise central apertures 396*a*, 396*b*, respectively comprise outer apertures 398*a*, 398*b*, respectively comprise spoke portions 297*a*, 297*b* and respectively comprise tab sections 394*a*, 394*b*.

One method for reducing the areal extent of the outer apertures—through which gas flows—would be to simply retain the same number of apertures while making each aperture smaller. Another method for reducing the areal extent of the outer apertures is as shown in the example of FIGS. 8C-8D, in which the number of equally-spaced-apart outer apertures is reduced (from six apertures to five apertures per plate) but the size of the apertures remains unchanged, with respect to the outer apertures 198*a*, 198*b* shown in FIGS. 8A-8B. Yet a third method for reducing the areal extent of the outer apertures is as shown in FIGS. 8E-8F, in which the number of apertures is reduced but the apertures are not equally spaced. This latter configuration would be beneficial for cases in which the delivery of ions into ion transport apparatus having the electrode plates 392*a*, 392*b* (and others) is not axisymmetric or is not aligned with respect to the axis of the apparatus. Such would be the case, for instance, if an ion transfer tube that inputs the ions makes a small angle relative to the axis of the device (as in FIG. 6) or if the bore of the ion transfer tube is not circular in cross section or if the ion transfer tube includes multiple bores. In these situations, the relative positions of the apertured and non-apertured sections of the electrode plates would be chosen in accordance with the direction or the asymmetry of the gas jet or jets being input to the apparatus.

The discussion included in this application is intended to serve as a basic description. Although the invention has been described in accordance with the various embodiments shown and described, one of ordinary skill in the art will readily recognize that there could be variations to the embodiments and those variations would be within the spirit and scope of the present invention. The reader should be aware that the specific discussion may not explicitly describe all embodiments possible; many alternatives are implicit. Accordingly, many modifications may be made by one of ordinary skill in the art without departing from the scope and essence of the invention. Neither the description nor the terminology is intended to limit the scope of the invention. Any patents, patent applications, patent application publications or other literature mentioned herein are hereby incorporated by reference herein in their respective entirety as if fully set forth herein.

What is claimed is:

1. An apparatus for transporting ions within a mass spectrometer comprising:

a plurality of electrodes, a plurality of surfaces of which comprise a plurality of non co-planar rings defining a set of respective ion apertures whose diameters decrease from a first end to a second end along a first direction parallel to an axis of the apparatus, the set of ion apertures defining an ion channel through which the ions are transported; and a Radio Frequency (RF) power supply for providing RF voltages to the plurality of electrodes such that the RF phase applied to each electrode is different from the RF phase applied to any immediately adjacent electrodes, wherein the electrodes are disposed such that gaps are defined between each pair of successive electrodes, the gaps being oriented such that a gas flow input into the first end of the apparatus is exhausted through the gaps in one or more directions that are non-perpendicular to the axis.

2. A apparatus as recited in claim 1, wherein the plurality of electrodes comprises a first set of electrodes and a second set of electrodes interleaved with the first set of electrodes, the electrodes of each set being electrically interconnected, wherein, in operation, the RF power supply supplies a first RF phase to the first set of electrodes and a second RF phase to the second set of electrodes.

3. An apparatus as recited in claim 1, wherein the plurality of surfaces comprises a plurality of end surfaces of a plurality co-axial hollow tubes comprising a plurality of respective tube lengths, the tube lengths of the tubes decreasing in sequence from an outermost one of the tubes to an innermost one of the tubes.

4. An apparatus as recited in claim 1, wherein each of the plurality of electrodes is a ring electrode.

5. An apparatus as recited in claim 4, wherein each of the plurality of ring electrodes is supported on a respective one of a plurality of co-axial hollow tubes, each tube formed of a non-electrically conducting material.

6. An apparatus as recited in claim 5, wherein the plurality of hollow tubes comprises a plurality of respective tube lengths, the tube lengths of the tubes decreasing in sequence from an outermost one of the tubes to an innermost one of the tubes.

7. An apparatus as recited in claim 1, wherein an outer surface and an inner surface of each electrode is a respective frustoconical surface and wherein each electrode comprises a respective axis of rotational symmetry that is coincident with the apparatus axis.

8. An apparatus as recited in claim 4, wherein each of the plurality of ring electrodes is supported on a respective one of a plurality of supporting structures having frustoconical inner and outer surfaces, wherein each supporting structure comprises a respective axis of rotational symmetry that is coincident with the apparatus axis.

9. An apparatus as recited in claim 4, wherein each of the plurality of ring electrodes is supported by one or more spokes disposed non-parallel to the apparatus axis, each of the spokes having an end that is physically coupled to an external housing or supporting device.

10. An apparatus as recited in claim 1, further comprising:

a second plurality of electrodes disposed between the plurality of electrodes and a source of the ions, the electrodes of the second plurality of electrodes electrically coupled to the Radio Frequency (RF) power supply for providing RF voltages to the second plurality of electrodes such that the RF phase applied to each electrode of the second plurality is different from the RF phase applied to any immediately adjacent electrodes, wherein the second plurality of electrodes provides a passageway for the ions comprising a length within which the ions may collide with a background gas.

11. An apparatus as recited in claim 10, wherein the length is greater than or equal to 55 millimeters.

12. An apparatus as recited in claim 10, wherein the second plurality of electrodes comprises a stacked-ring ion guide.

13. An apparatus for transporting ions within a mass spectrometer comprising:

a plurality of parallel spaced-apart plates, each of the plurality of plates having a central aperture and a plurality of other apertures, a portion of each plate between the central aperture and the other apertures comprising an electrode in the form of a ring about the respective central aperture, the set of central apertures having diameters that decrease from a first end to a second end along a first direction parallel to an axis of the apparatus, the set of central apertures defining an ion channel through which the ions are transported; and a Radio Frequency (RF) power supply for providing RF voltages to the plurality of electrodes such that the RF phase applied to each electrode is different from the RF phase applied to any immediately adjacent electrodes, wherein the other apertures are disposed such that a gas flow input into the first end of the apparatus is exhausted through the other apertures in one or more directions that are non-perpendicular to the axis.

14. An ion transport apparatus as recited in claim 13, wherein the parallel plates are disposed substantially perpendicular to the apparatus axis.

15. An ion transport apparatus as recited in claim 13, wherein the other apertures of two or more successive plates increase in size along the first direction.

16. An ion transport apparatus as recited in claim 13, wherein the other apertures of at least one plate are asymmetrically disposed about the central aperture.

17. An ion transport apparatus as recited in claim 13, wherein the area of the electrode in the form of a ring increases between two or more successive parallel plates along the first direction.

18. An ion transport apparatus as recited in claim 13, wherein a portion of each plate other than between the central aperture and the other apertures is formed an electrically non-conductive material.

19. An ion transport apparatus as recited in claim 13, wherein each plate is formed of a single integral piece comprising an electrically conductive material.

20. An ion transport apparatus as recited in claim 13, further comprising:

a plurality of electrode plates disposed between the parallel spaced-apart plates and a source of the ions, each of the electrode plates electrically coupled to the Radio Frequency (RF) power supply for providing RF voltages to the plurality of electrode plates such that the RF phase applied to each electrode plate is different from the RF phase applied to any immediately adjacent electrode plates, wherein plurality of electrode plates provides a passageway for the ions comprising a length within which the ions may collide with a background gas.

21. An apparatus as recited in claim 20, wherein the length is greater than or equal to 55 millimeters.

22. An apparatus as recited in claim 20, wherein the plurality of electrode plates comprises a stacked-ring ion guide.

23. A method for transporting ions within a mass spectrometer from an emitter that emits the ions and neutral gas molecules to an entrance aperture of a vacuum chamber comprising:

inputting the ions and neutral gas molecules to a first end of an ion transport apparatus comprising a plurality of non co-planar ring-shaped electrode portions having respective central apertures having central aperture centers that all lie along a common axis and that define an ion channel, wherein the radii of the central apertures decrease in a direction from the first end to a second end of the ion transport apparatus;

applying a set of Radio Frequency (RF) voltages to the plurality of ring-shaped electrode portions such that the ions remain substantially confined to the ion channel while passing from the first end to an ion outlet at the second of the ion transport apparatus; and exhausting the neutral gas molecules from the ion transport apparatus though a plurality of gas channels or apertures other than the apertures that define the ion channel, the exhausting performed in one or more directions that are non-perpendicular to the axis.

24. A method for transporting ions within a mass spectrometer as recited in claim 23, wherein the step of exhausting the neutral gas molecules from the ion transport apparatus though a plurality of gas channels or apertures that surround the ion channel comprises exhausting the neutral gas molecules from the ion transport apparatus though a plurality of gas channels comprising gaps between a plurality a plurality of nested co-axial hollow tubes.

25. A method for transporting ions within a mass spectrometer as recited in claim 23, wherein the step of exhausting the neutral gas molecules from the ion transport apparatus though a plurality of gas channels or apertures that surround the ion channel comprises exhausting the neutral gas molecules from the ion transport apparatus though a plurality of apertures in a plurality of electrode plates having the plurality of ring-shaped electrode portions.

26. A method for transporting ions within a mass spectrometer as recited in claim 23, wherein the step of exhausting the neutral gas molecules from the ion transport apparatus though a plurality of gas channels or apertures that surround the ion channel comprises exhausting the neutral gas molecules from the ion transport apparatus though a plurality of gas channels comprising gaps between a plurality a plurality of nested electrode portions having shapes defined by bounding frustoconical surfaces.

* * * * *